US005651169A

United States Patent [19]

Ohuchi et al.

[11] Patent Number: 5,651,169

[45] Date of Patent: Jul. 29, 1997

[54] CONTINUOUS RIVETING MACHINE FOR FASTENING BLIND RIVETS

[75] Inventors: Masatoshi Ohuchi, Koriyama; Masaru Matsumoto, Machida, both of Japan

[73] Assignee: OPT Engineering Co., Ltd., Koriyama, Japan

[21] Appl. No.: 692,727

[22] Filed: Aug. 6, 1996

Related U.S. Application Data

[62] Division of Ser. No. 449,484, May 24, 1995, Pat. No. 5,544,407, which is a division of Ser. No. 92,201, Jul. 14, 1993, abandoned.

[30] Foreign Application Priority Data

Dec. 29, 1992 [JP] Japan ..... 4-360303

[51] Int. Cl.[6] ..... B21J 15/22

[52] U.S. Cl. ..... 29/243.525; 29/812.5; 29/DIG. 44; 227/57; 227/130

[58] Field of Search ..... 29/34 B, 243.521, 29/243.522, 243.523, 243.524, 243.525, 524.1, 812.5, DIG. 44; 227/57, 112, 129, 130, 136

[56] References Cited

U.S. PATENT DOCUMENTS

| | | | |
|---|---|---|---|
| 3,733,882 | 5/1973 | Klein | 29/243.524 X |
| 4,310,056 | 1/1982 | Olsson | 29/243.525 X |
| 4,515,005 | 5/1985 | Klein | 29/243.525 |
| 4,704,888 | 11/1987 | Frearson | 29/243.525 |
| 5,205,456 | 4/1993 | Ohuchi et al. | 227/57 |

FOREIGN PATENT DOCUMENTS

| | | | |
|---|---|---|---|
| 6178526 | 4/1986 | Japan | 29/524.1 |

*Primary Examiner*—Peter Vo

*Attorney, Agent, or Firm*—Lackenbach Siegel Marzullo Aronson & Greenspan, PC

[57] ABSTRACT

Although the conventional continuous riveting machine was able to use exclusively a special blind rivet having a longer core-stem than that of the standard type, the continuous riveting machine according to the present invention is able to use the standard blind rivet and also able to recover separately torn core rivet stems and a blind rivet-holding belt made of plastic material enabling the supply of blind rivets in series. When a lower piston 600 descends in a jaw cylinder 400, a nose piece 620 integrated in one piece with the lower piston 600 also descends while bending downwardly plastic upper and lower tabs of the blind rivet-holding belt, and holding the blind rivet. Torn-core-stems are absorbed and stored in a torn core rivet stems storing case installed on the upper portion of the jaw cylinder by applying vacuum air absorbing force generated in a vacuum ejector.

1 Claim, 19 Drawing Sheets

CONTINUOUS RIVETING MACHINE FOR FASTENING BLIND RIVETS

This is a division of application Ser. No. 08/449,484; filed May 24, 1995, now U.S. Pat. No. 5,544,407, which is a division of Ser. No. 08/092,201, filed Jul. 14, 1993, now abandoned.

BACKGROUND OF THE INVENTION

The present invention relates to a continuous riveting machine for fastening blind rivets and, more particularly, relates to a continuous riveting machine enabling torn core rivet stems to be stored in a torn stem-recovering chamber installed in the riveting machine and enabling each of the partially deformed continuous rivet holders to be discharged.

Up to the present, conventional single rivet-loading riveters were constructed so that a blind rivet was loaded into the under portion of the nose piece of the riveter one by one in every riveting operation, and the torn core rivet stems of that blind rivet were discharged from the above portion of the riveter, as disclosed in prior art laid open as Japan Patent Application No. Showa 61 (1986)-78526.

However, in this riveter, because the blind rivet must be inserted for every riveting operation, the riveter was cumbersome to operate and the discharged torn core rivet stems were dispersed around the working place.

In order to solve the above-mentioned disadvantages, the applicants of the present invention invented the improved continuous riveting machine enabling continuous loading of the blind rivets, preventing the dispersion of torn core rivet stems by discharging them outwards together with a rivet-holding belt. This improved continuous riveting machine is disclosed in Japan Patent Application No. Heisei 3 (1991)-152150, and as shown in FIG. 14 to FIG. 25, is comprised of a main body section A, a drive section B and a rivet supply section C.

By combining FIG. 14 with FIG. 15, the improved continuous riveting machine with an operating lever released is displayed as a whole.

By combining FIG. 16 with FIG. 18 or FIG. 17 with FIG. 18, the improved continuous riveting machine with the operating lever gripped is shown as a whole. While the air piston 2 is in the far most advanced position as shown in FIG. 18, each position of the miscellaneous pistons located in the main body section A and the position of the blind rivet are transferred from the state shown in FIG. 16 to that shown in FIG. 17.

The drive section B is composed of a small diametral hydraulic cylinder 12 and a large diametral air cylinder 1 connected to the hydraulic cylinder 12. This hydraulic cylinder 12 is branched sidewise and a little upwardly oblique from the main body section A, and is integrated in one piece with a pneumatic and hydraulic cylinder 5. A piston rod 3 integrated in one piece with a piston 2 is inserted in the air cylinder 1 and slidably inserted in the hydraulic chamber 12*a* so as to be servable as a piston of the hydraulic cylinder 12.

In the under portion of the air cylinder 1, a shaft hole 41 is shaped and connected to an air exiting port 40 located on the under portion of the air cylinder 1, and a valve chamber 44 is shaped at the rear end of the shaft hole 41. Both enlarged portions of the shaft hole 41 are connected to the air cylinder 1 through connecting paths 42 and 43. Also in the shaft hole 41, a valve shaft 6 having a value 8 for closing the path 43 at the rear end thereof, and a plug 70 for closing the shaft hole 41 at the front end thereof, are slidably inserted. The valve shaft 6 is usually energized to move forwardly by a spring 25.

A trigger lever 9 and a valve cam 10 are pivotally supported by spring pins 45 and 46 biasing them to rotate clockwise, and the operating lever 9 and the valve cam 10 are connected together with a connecting rod 11 by spring pins 47, 48 pivotally placed on the above portion of the lever 9 and the valve cam 10. Further, the lower tip of the valve cam 10 contacts with the front face of the plug 70.

In the main body section A, a cylindrical rivet nose 18 is connected to the bottom portion of a pneumatic hydraulic cylinder 5 integrated in one piece with the hydraulic cylinder 12 through a chuck cylinder 73. Inserted into the pneumatic hydraulic cylinder 5 is a pneumatic-hydraulic piston 13 dividing the inner portion of the cylinder 5 into an upper air chamber 5*b* and a lower hydraulic oil chamber 5*a*, and a cylindrical body 13*a* is integrally shaped in one piece with the under portion of the pneumatic hydraulic piston 13 and the air chamber 5*b* connected to an air chamber 72 shaped at the rear end of the valve chamber 44 of the drive section B through the air pipe 71, and the oil chamber 5*a* is connected to the oil chamber 12*a* of the hydraulic oil cylinder 12.

In the chuck cylinder 73, a hollow chuck piston 75 having a cylindrical body 74 integrally shared with the piston 73 is inserted. In the cylindrical body 13*a* of the pneumatic hydraulic piston 13, a coil spring 76*a* is inserted, and a rod 76 energized downwardly by the coil spring 76*a* is retractably extruded from a bottom wall of the cylindrical body 13*a*. On the lower tip of the rod 76, a hollow jaw case 77 moving slidably in the cylindrical body 74 of the chuck piston 75 is installed.

In the lower inner surface of the jaw case 77 is shaped a tapered circular surface 78 converging downwardly. A pair of jaws 14 are slidably inserted in the surface 78. Each of the jaws 14 is downwardly and outwardly energized by a spring 79 inserted in said jaw case 77 through a jaw pusher 80 having a V-shaped tip. Further, the bottom end of the cylindrical body 74 is closed except the hole for allowing passage of the core stem of the blind rivet, and each tip of said jaw case 77 and the jaws 14 contact with the bottom wall 74*a* of the body 74 in the state shown in FIG. 14 and FIG. 17.

The air chamber 81 positioned under the chuck piston 75 inserted in the chuck cylinder 73 is connected to the air port 82 located on the front end of the air cylinder 1 of the drive section B through an air supply pipe 83. Also, as shown in FIG. 22, in the bottom inner portion of the rivet nose 18, a pair of nose pieces 19 are pivotally supported and biased inwardly by a pair of springs 29 mounted on a pair of set screws 51.

Furthermore, in FIG. 22, numeral 53 identifies a pair of rivet passing holes for the blind rivet 33, and numeral 100 identifies the blind rivet holding belt described as follows.

The blind rivet holding belt 100 is shaped as a channeled section made of polypropylene, and has a plural of feed holes 105*d* and upper and bottom tabs in every specified distance.

The rivet supply section C is composed of a rivet feed air cylinder 58 integrally installed on the side surface of the rivet nose 18, and a guide plate 59, as shown in FIG. 19 to FIG. 22. In FIG. 20, a piston 22 forwardly biased by a spring 31, is inserted in the rivet feed air cylinder 58, and in the piston 22, a shaft 23 having a feed pawl 23*a* is inserted and fixed by a screw 23b for preventing said shaft 23 from falling out. Furthermore, as shown in FIG. 17 the rivet feed air cylinder 58 is connected to the port 81a located on the upper portion of the chuck cylinder 73 through an air pipe 84.

Also in FIG. 19 and FIG. 20, (which is a sectional view taken along the section line 20—20 of FIG. 19) numeral 58a identifies an air port connected to the air pipe 84 (shown in FIGS. 14 and 16–17).

The guide plate 59 has a pair of extrusions 60, 60 located upper and lower edges of the guide plate 59 for guiding the blind rivet-holding belt 100, a long hole 61 shown in FIG. 14, FIG. 16, FIG. 17, FIG. 20 and FIG. 21 for guiding the feed pawl 23a, and a nail 59a for preventing reverse motion of the blind rivet holding belt 100 protruding therefrom. Further, numeral 20 in FIG. 22 is a blind rivet-holding belt-pressing plate, and installed in the rivet nose 18 through a pair of pistons 21 and a pair of biasing springs 30, 30 for elastically pushing the blind rivet holding belt 100 against the guide plate 59. Also, a covering plate 30a fixed on the rivet nose 18 by screw threads (not shown) presses the springs 30 toward the pistons 21. Furthermore, numeral 34 shown in FIG. 14, FIG. 16, and FIG. 18 is a magazine for containing the blind rivet holding belt 100.

This rivet-containing magazine 34 is shaped in cylindrical form having a vertical axis against the longitudinal direction of the guide plate 59, then the blind rivet-holding belt 100 is wound spirally along said inner cylindrical wall, and is fed out along the guide plate 59.

The working of this improved continuous riveting machine constructed as described above in detail, is next described as follows.

The blind rivet-holding belt 100 is usually contained in the magazine 34, and before riveting, this riveting machine is in the state shown in FIG. 14. Namely, the operating lever 9 is released, and the blind rivet 33 is extruded downwardly from the bottom of the opened nose pieces 19.

In this condition, after the air supply port 50 (shown in FIG. 14) is connected to the pressurized air supply source (not shown), the main body of the blind rivet 33 is put in the hole of the steel sheets 63 to be riveted as shown in FIG. 14. Then by gripping the operating lever 9, the valve shaft 6 and the valve 8 go back, as the valve cam 10 rotates counter-clockwise through the connecting rod 11 as shown in FIG. 18. As pressurized air is introduced into the air cylinder 1 through the connecting hole 43, the piston 2 advances, the hydraulic oil in the oil chamber 12a is supplied in the oil chamber 5a, and the pneumatic hydraulic piston 13 is raised to the top dead position as shown in FIG. 16.

Accordingly, the rod 76 and the jaw case 77 are raised upwardly. In this state, as a pair of jaws 14 are being biased downwardly by the spring 79 through the jaw pusher 80, the jaws 14 are slidably and downwardly extruded along the tapered surface 78 shaped on the jaw case 77 and go up while gripping the core stem 33a of the blind rivet 33. By pulling up the core stem 33a, the riveting action of the blind rivet 33 is performed. The core stem 33a is then torn from the blind rivet 33 at the position equivalent to the tip position of the nose piece 19.

As shown in FIG. 18, when the piston 2 reaches the stroke end, the pressurized air in the air cylinder 1 is supplied to the air chamber 81 from the air port 82 through the air pipe 83 shown in FIG. 17.

Accordingly, as also shown in FIG. 17, while the chuck piston 75 and the cylindrical body 74 rise up, at first a liner 74a in the body 74 contacts the tips of the jaws 14 and pushes up the jaws 14, then contacts the tip of the jaw case 77, and the jaws are accordingly opened.

Then, the cylindrical body 74 further rises from that position and the jaw case 77 also rises while compressing the bias spring 76a, and reaches the condition shown in FIG. 17.

When the chuck piston 75 reaches the top dead position, the pressurized air filled in the chuck cylinder 73 through the air pipe 83 is supplied to the rivet feed air cylinder 58 through the port 81a, the air pipe 83 and the port 58a. As shown in FIG. 20, the piston 22 then moves in the direction indicated by arrow, the feed pawl 23a installed on the tip of the shaft 23 moves along the long hole 61, and then the feed pawl 23a engaged with the feed hole 105 of the blind-rivet holding belt 100 transfers the holder 100 as much as one pitch, and sets the tip of the blind rivet 33 in the specified position in the rivet nose 18. (See FIG. 17).

Next, by releasing the operation lever 9, as shown in FIG. 15, owing to the clockwise rotation of the valve cam 10, the valve 8 is closed by the biasing force of the spring 25, the pressurized air is supplied into the air chamber 5b of the pneumatic-hydraulic cylinder 5 through the air chamber 72, the air pipe 71, as shown in FIG. 14, then the rod 76, the jaw case 77, the pneumatic-hydraulic piston 13, the chuck piston 75 and the cylindrical body 74 are pushed downwardly to the lower limit positions. In this case, as shown in FIG. 14, as the upper portion of the core stem 33a of the blind rivet 33 is inserted between a pair of jaws 14, 14, and contacts the bottom end of the jaw pusher 80, the blind rivet 33 is pushed downwardly. And after opening a pair of the nose pieces 19, the rivet 33 stops in the position of being extruded from the nose piece 19.

Furthermore, in this condition, as the pressurized air supply to the air cylinder 58 is exchanged and air pressure in the cylinder 58 is exhausted, the piston 22 of the rivet feed air cylinder simultaneously towards the left side as shown in FIG. 20 (in FIG. 14, moves towards the right). However, the blind rivet-holding belt 100 is prevented from reverse motion by the nail 59a, and only the feed pawl 23a disengaged from the feed hole 105 of the blind rivet-holding belt 100 moves backwardly as much as one pitch as said holder 100 remains at the present position, and again engages with the feed hole 105d positioned backwardly as much as one pitch.

According to the above description, one blind rivet 33 is riveted, and by repeating the aforementioned operation, it is possible to perform continuous riveting.

Also, as shown in FIG. 14, FIG. 16 and FIG. 17, the torn core stem 33a is continuously discharged while being inserted in the through hole of the holder 100 through the pass hole 53 shown in FIG. 22.

If the blind rivet-holding belts 100 in the containing magazine 34 are consumed, or if using the riveting machine originally charged with the holder 100 therein, the blind rivet 33 first placed on the head position of the rivet-holding belt 100 is placed on the position shown in FIG. 23, then by gripping the operating lever 9, raising the pneumatic hydraulic piston 13 and the chuck piston 75 simultaneously the blind rivet 33 is fed into the specified position.

In this case, the bottom end of the cylindrical body 74 and the blind rivet 33 are located in the positions shown in FIG. 13.

Next, by releasing the operating lever 9, the pneumatic-hydraulic piston 13 and the chuck piston 75 are pushed downwardly, the blind rivet 33 opens a pair of the nose pieces 19, 19 and extrudes from the bottom surface of these pieces 19, and all riveting preparations are finished.

The preceding actions are performed according to the above-described process. However, in this continuous riveting machine described above there existed the following drawbacks.

The length of the core stem 33*a* of the blind rivet 33 applicable to this riveting machine is longer than that of the standard blind rivet provided on the market.

As the torn core stems 33*a* are discharged together with the rivet holding-belt 100 while being kept between the tabs of the holding belt, there are drawbacks such as injury to the operator's hands, and extrusion from the dust bag and bulkiness. Furthermore, it is cumbersome to separate the torn core stems made of metal and the holding belt made of plastics such as polypropylene when disposing of them.

The present invention was developed in consideration of the above-mentioned drawbacks, and its object is to provide a continuous riveting machine able to use standard blind rivets provided on the market and to continuously recover the torn core rivet stem of the blind rivets in the core-stem-storing case installed in the main body of the riveting machine.

SUMMARY OF THE INVENTION

A continuous riveting method according to the present invention is comprised of:

(1) supplying pressurized hydraulic oil into the oil chamber formed between an upper piston and a lower piston inserted up and down in a jaw cylinder;

pulling up said upper piston integrated in one piece with an inner sleeve having a pair of jaws gripping the core stem of a blind rivet as much as specified distance while said lower piston is pressed down against a cylinder cover of said jaw cylinder;

in company with riveting the blind rivet, tearing the core-stem from the main body of the blind rivet;

(2) feeding a blind rivet-holding belt as much as one pitch, after pulling up the lower piston together with the upper piston until above a core-stem of blind rivets parallely held in the blind rivet-holding belt;

3) successively letting down the upper piston and the lower piston in order to let the core-stem of said blind rivet pass through a nose piece installed in the tip portion of the lower piston and freely engage to a pair of opened jaws, and letting down the tip portion of the lower piston while bending downwardly the upper and lower taps of the rivet holding belt.

2. A continuous riveting machine according to the present invention comprising:

a main body section, a driving section, a rivet supply section and a valve section;

the main body section comprising a core-stem storing case provided with a vacuum air ejector for vacuuming the inside of the case, a jaw cylinder provided with the core-stem storing case on the upper end thereof and a cylinder cover on the bottom thereof, an upper piston inserted in the jaw cylinder, the upper piston shaped as a cup opened upwardly; the piston slidably inserted on the core-stem storing case, the piston integrated in one piece with a hollow cylindrical sleeve having a hollowed bottom on the bottom thereof, the cylindrical sleeve having an inner sleeve integrated in one piece on the bottom thereof, the inner sleeve having a tapered surface converging toward the tip thereof in the inner tip thereof, a lower piston inserted in the lower portion of the jaw cylinder, the lower piston having an outer sleeve integrated in one piece at the bottom thereof;

the outer sleeve being freely slidable in the hole of the cylinder cover of the jaw cylinder, the outer sleeve being freely slidable on the inner sleeve, the outer sleeve having a nose piece on the bottom portion thereof, the nose piece having an elastic ring enabling a core-stem of a blind rivet to be held therein, a pair of jaws slidably fit to the tapered surface, the jaws being biased downwardly and externally by a spring via a sharply edged jaw pusher, a core-stem absorbing pipe fixed to the bottom plate of the core-stem storing case after penetrating the bottom plate, the pipe being inserted in the inner sleeve at the lower end thereof, the driving section comprising, an air cylinder having a piston, an oil cylinder having an oil piston integrated in one piece with the piston of the air cylinder, the oil cylinder supplying pressurized hydraulic oil into an oil chamber shaped between the upper piston and the lower piston inserted in the jaw cylinder through a connecting oil hole shaped on the side wall of the jaw cylinder, a first air port supplying pressurized air into a rear air chamber of the air cylinder, a second air port supplying pressurized air into a front air chamber of the air cylinder, said vacuum air ejector, an air chamber formed between the lower piston of the jaw cylinder and the cylinder cover of the jaw cylinder, and a third air port connected to an air port provided on the wall of the air cylinder located directly behind the far advanced piston.

The rivet supply section comprising;

a construction transferring each core stem of a blind rivet held with specified distance in a blind rivet-holding belt toward the lower position under the nose piece installed in the outer sleeve when the upper piston and lower piston inserted in the jaw cylinder reach each lower dead position.

Said valve section comprising;

a two positioned trigger valve manipulated by hand:

a piloted two positioned control valve operated by pressurized pilot air fed from one of the outlet ports of the trigger valve and the third air port; and an air control system comprising one outlet port of the control valve being connected to the first air port, another outlet port of the control valve being connected to the second air port, one outlet port of the trigger valve being connected to an air port installed on the upper portion of the jaw cylinder, another outlet port of the trigger valve being connected to one inlet port of the control valve, another inlet port of the control valve and said trigger valve being discharged into the air, and another inlet port of the trigger valve connected to a pressurized air source.

As the core stem of the blind rivet is slidably held by the elasticity of the elastic ring installed in the nose piece, the blind rivet does not drop downward while being held in the nose piece.

When the upper piston and lower piston ascend to the upper dead point of each piston, the core-stem of the blind rivet is located above the axis of the nose piece, and when the upper and lower pistons descend, the core stem of the blind rivet passes through the inner hole of the nose piece and is held by the elastic force of the elastic ring, and is inserted in the divided holes of the opened jaws. When the nose piece descends, the tip of the nose piece downwardly bends the upper and lower tabs of the rivet-holding belt and the nose piece descends to the lower dead point.

When fastening the blind rivet, as pressurized hydraulic oil is charged into the oil chamber shaped between the upper and lower pistons in the jaw cylinder, and the upper piston is pulled up with the lower piston pressed downwardly against the cylinder cover, it is possible to install the nose piece in the outer sleeve fixed to the lower piston. Accordingly, as there is no need to install an openable nose piece at the under position of a guide plate for guiding the rivet-holding belt, it becomes possible to make the length of the core-stem of the blind rivet shorter than that used in the conventional continuous riveting machine.

DETAILED DESCRIPTION OF THE INVENTION

The foregoing and other objects, features and advantages of the present invention will become more apparent from a reading of the following detailed description in connection with the accompanying drawings.

Figure 1:
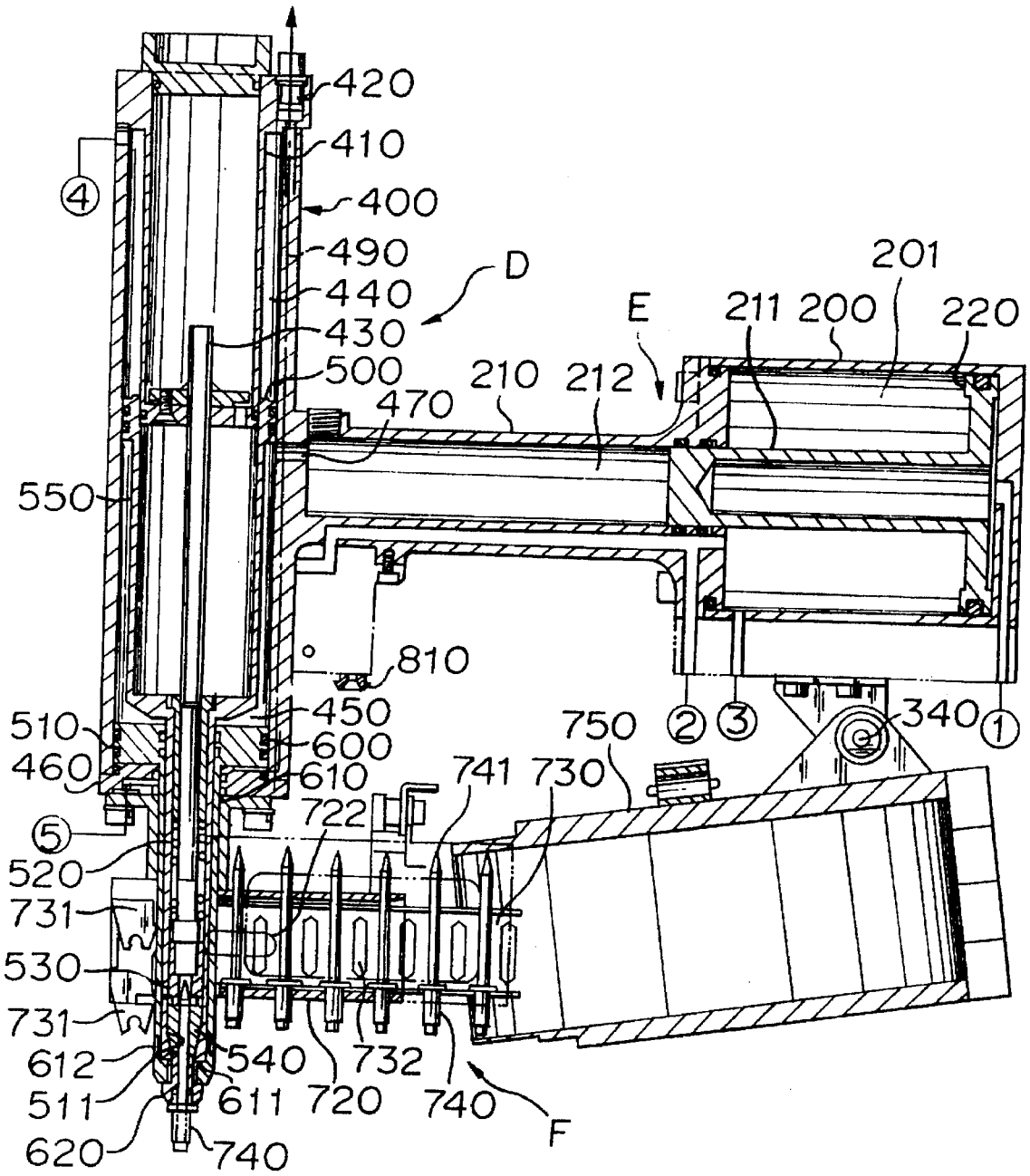
FIG. 1 shows a sectional vertical view of the embodiment according to the present invention and shows the upper and lower pistons descended to the lowest position, and the preparation for riveting processed.
Figure 2:
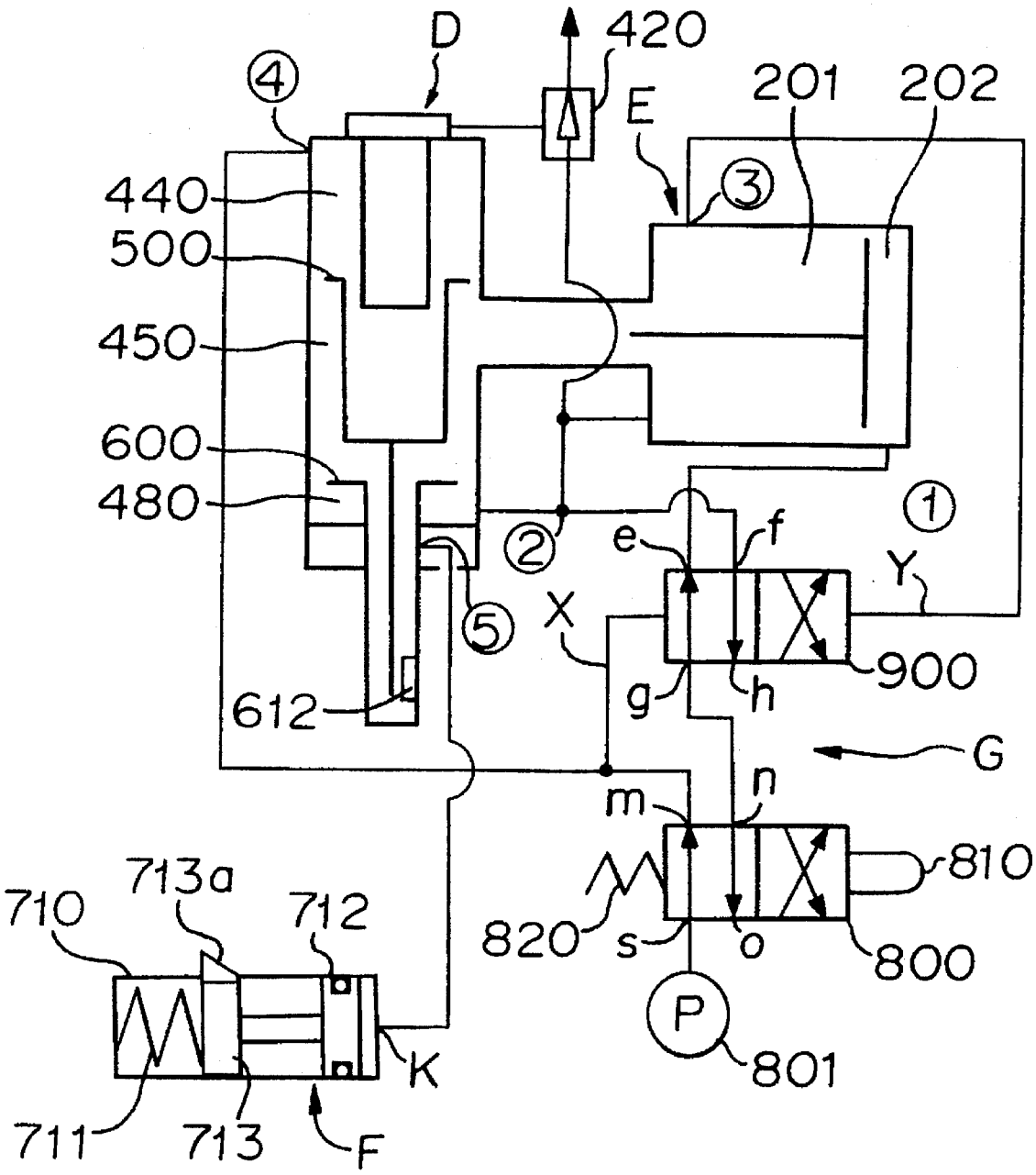
FIG. 2 shows an air piping system for controlling the embodiment shown in FIG. 1, and shows the trigger valve and the control valve positioned in the first stage corresponding to the state shown in FIG. 1.

The preferred embodiment of the continuous riveting machine according to the present invention is comprised of a main body section D, a driving section E, a rivet supply section F and a controlling section G, and FIG. 1 shows a push button of a trigger valve 810 released, and FIG. 2 shows the push button activated.

The driving section E is comprised of a small diametral oil cylinder 210 branched sidewisely from the main body section D and a large diametral air cylinder 200 activating an oil piston 211 inserted in the oil cylinder 210 and a piston 220 inserted in the air cylinder 200 is integrated in one piece with the oil piston 211. The oil cylinder 210 is connected to an oil chamber 450 equivalent to the space shaped between an upper piston 500 and a lower piston 600 inserted in a pneumatic hydraulic jaw cylinder 400 through an oil port 470 shaped on the side wall of the jaw cylinder 400. A secondary air port 2 supplies pressurized air into a front air chamber 201 of the air cylinder 200, an air chamber 480 located between the lower piston 600 and a bottom cylinder cover 460 of the jaw cylinder 400 and a vacuum air ejector 420 installed on the upper portion of the jaw cylinder 400, and connected to an air port f located on the one side of a control valve 900. A first air port 1 supplies pressurized air into a rear air chamber 202 (shown in FIG. 3) and connected to an air port e located on the one side of the control valve 90. A third air port 3 feeds pressurized air existing in the rear air chamber 202 of the air cylinder 200 to a pilot air path Y of the control valve 900. And on the lower portion of the air cylinder 200, a magazine 750 belonging to the rivet supply section F is pivotally supported by a supporting pin 340.

The main body section D is comprised of the pneumatic hydraulic jaw cylinder 400 vertically integrated in one piece with the oil cylinder 210, and a torn core rivet stem-storing chamber 410 installed on the jaw cylinder 400 for closing the upper end of the jaw cylinder, and a rivet supply section F is installed on the lower end of the jaw cylinder 400. On the upper portion of the torn core rivet stems storing chamber 410, a vacuum air ejector 420 is installed for vacuuming the storing chamber 400. On the bottom end of the jaw cylinder 400, the cylinder cover 460 is securely fixed.

The upper piston 500 is inserted in the jaw cylinder 400. The upper piston 500 is shaped to open upwardly for sliding along the outer surface of the torn core rivet stems storing chamber 410 while sliding in the jaw cylinder 400. The upper piston 500 is integrated in one piece with a cylindrical sleeve 550 and with an inner sleeve 510. The cylindrical sleeve 550 has sufficient length and the internal surface sliding on the outer surface of the torn-rivet-seams storing chamber 410, and the inner sleeve 510 is installed on the bottom end thereof. A tapered surface 511 converging towards the tip portion is shaped in the inner tip portion of the inner sleeve 510. A pair of jaws 540 are slidably inserted in the tapered surface 511. Each of the jaws 540 is biased downwardly and externally by the biasing spring 520 through a jaw case 530 having a V-shaped edge. Furthermore, a torn core rivet stem-absorbing pipe 430 is slidably inserted in the inner sleeve 510, the upper end thereof securely fixed to the bottom plate of the torn core rivet stems storing chamber 410 so as to be a little extruded above the bottom plate. The lower piston 600 inserted in the jaw cylinder 400 is placed under the upper piston 500, an upper oil chamber 450 is shaped between the upper piston 500 and the cylindrical sleeve 550, and a lower air chamber 480 is shaped between the cylinder cover 460 and the lower piston 600. The lower piston 600 is also integrated in one piece with an outer sleeve 610, and the outer piece 610 is slidably inserted in the cylinder cover 460. In the bottom end of the outer sleeve 610, a nose piece 620 is inserted. Furthermore, in the conditions shown in FIG. 1, FIG. 5 and FIG. 7, the tip portion of the inner sleeve 510 is contacted with a bottom wall 611 of the outer sleeve 610, and the tip portions of the jaws 540 are contacted with a V-shaped tip portion of the nose piece 620 intruded in the inner sleeve 510. In the nose piece 620, the hole in which the rivet-core-stem passes through is shaped, and in the tip portion thereof, an elastic ring 621 (shown in FIG. 10) is installed.

The elastic ring 621 slidably holds the rivet-core-stem 741 by an elastic property thereof for preventing the blind rivet 740 from falling out during the riveting work. In the side wall of the jaw cylinder 400, an air path 490 connecting the lower air chamber 480 to the vacuum air ejector 420 is shaped, and on the middle portion of the path 490, an air port 470 connected to the second air port 2 is shaped.

Figure 9:
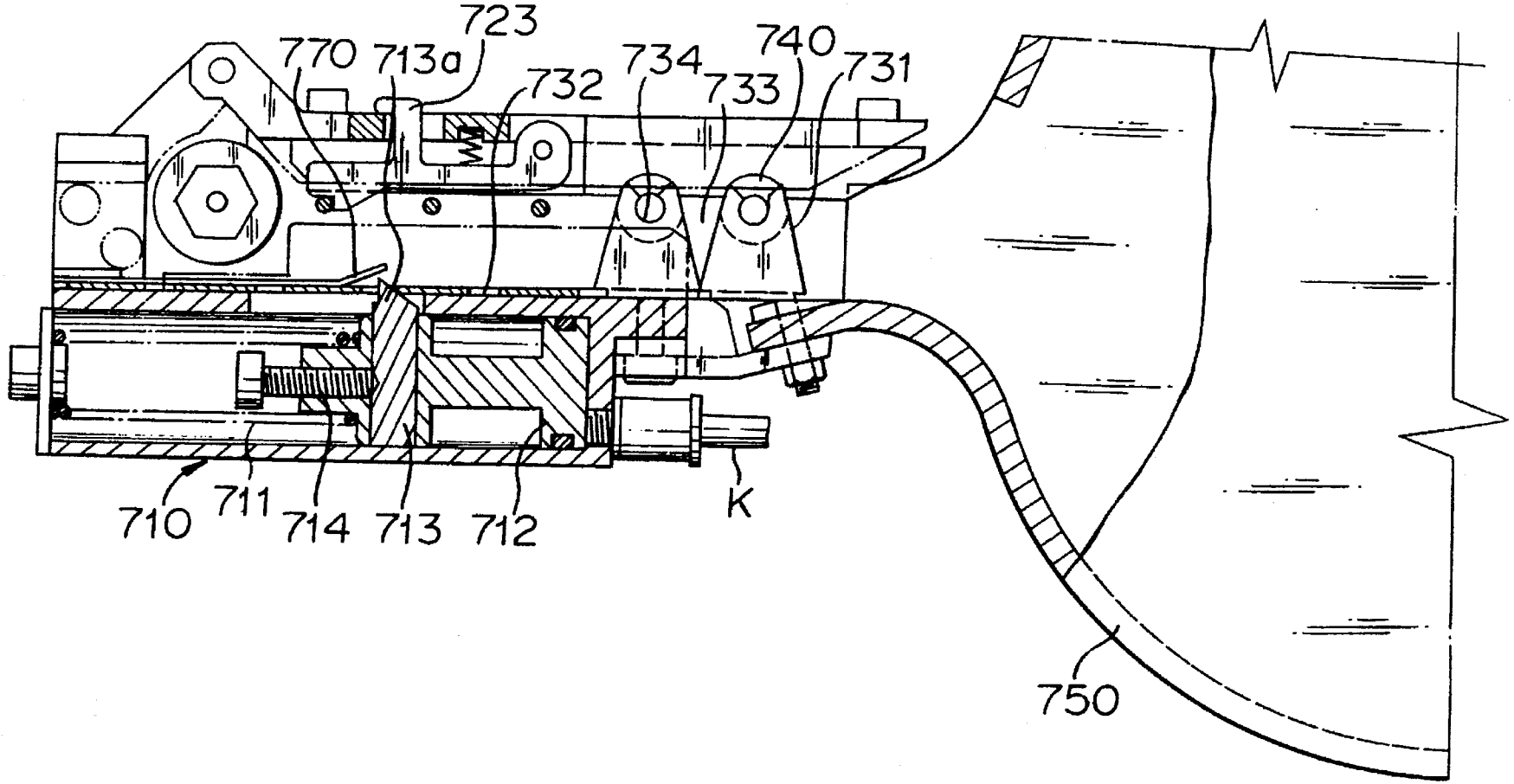
FIG. 9 shows a sectional plan view of the rivet supply section of the embodiment shown in FIG. 1.

The rivet supply section F is comprised of a rivet feed air cylinder 710 and a guide device 720 for guiding the rivet holding belt 730 as shown in FIG. 1, FIG. 3 and FIG. 5–FIG. 7. The rivet holding belt 730 made of polypropylene or the like is shaped like a channel, and has a feed hole 732 and a pair of tabs 731 located on the upper and bottom sides at every specified distance. Between tabs being next door to each other, a V-shaped notch 733 (shown in FIG. 9) is shaped, and the tip of the tab 731 is cut to shape a V-notch 734 for holding the rivet-core-stem 741 and the rivet main body 742. In the rivet feed air cylinder 710, as shown in FIG. 9, a rivet feed piston 712 energized forwardly by a biasing spring 711 is inserted therein, and in the piston 712, a trigger pin 713 having a feed pawl 713*a* set by a small screw to prevent the piston 712 from falling out. On the guide device 720, extrusions for guiding the rivet-holding belt 730 are shaped, and a long hole 722 in which the trigger pin 713 reciprocates. Also, the blind rivet-holding belt 730 is pressed toward the guide device 720 by a plate spring 770, and on the guide device 720, a lever preventing reverse motion of the belt 730.

A plate spring 770 elastically presses the blind rivet-holding belt 730 against the guide device 720 and prevents the belt 740 from deviating from the specified course. The construction of the magazine 750 is the same as that of the conventional riveting machine.

Figure 4:
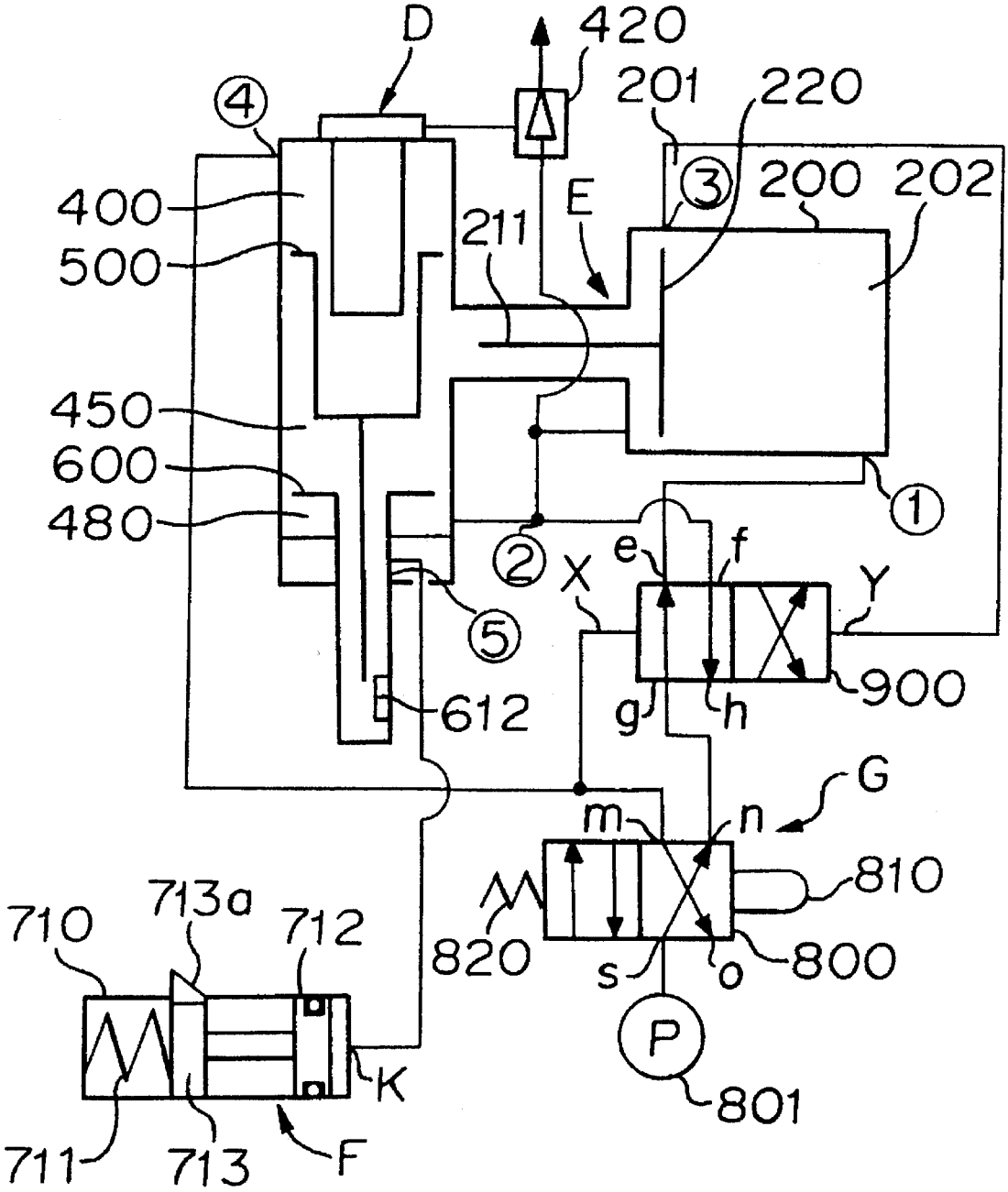
FIG. 4 shows the air piping system in which the trigger valve is switched in the second stage by pressing pushing button 810 corresponding to the state shown in FIG. 3.
Figure 7:
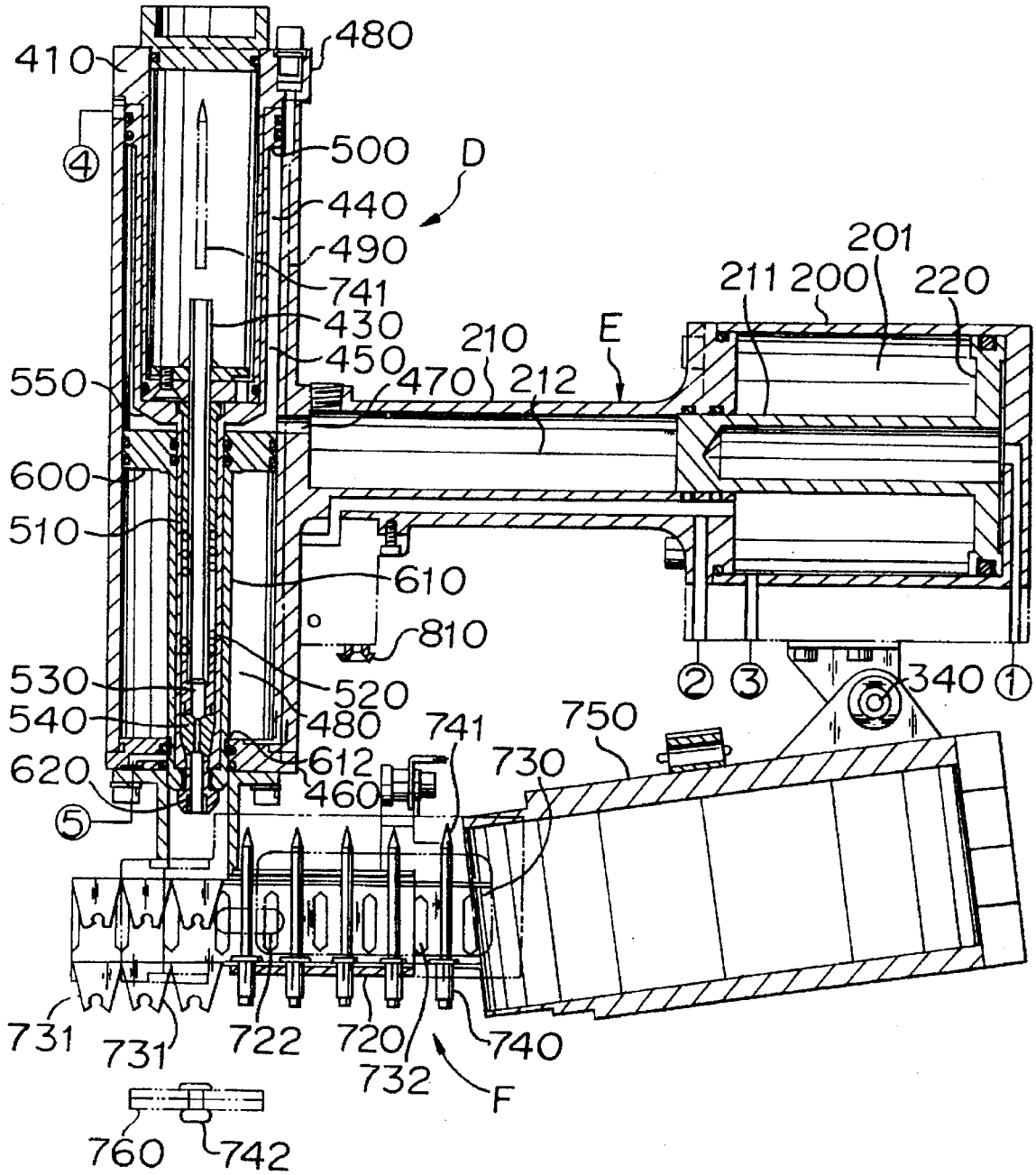
FIG. 7 shows the embodiment shown in FIG. 1 in which the upper and lower pistons are raised to each upper dead point for transferring new blind rivets into the riveting machine.
Figure 8:
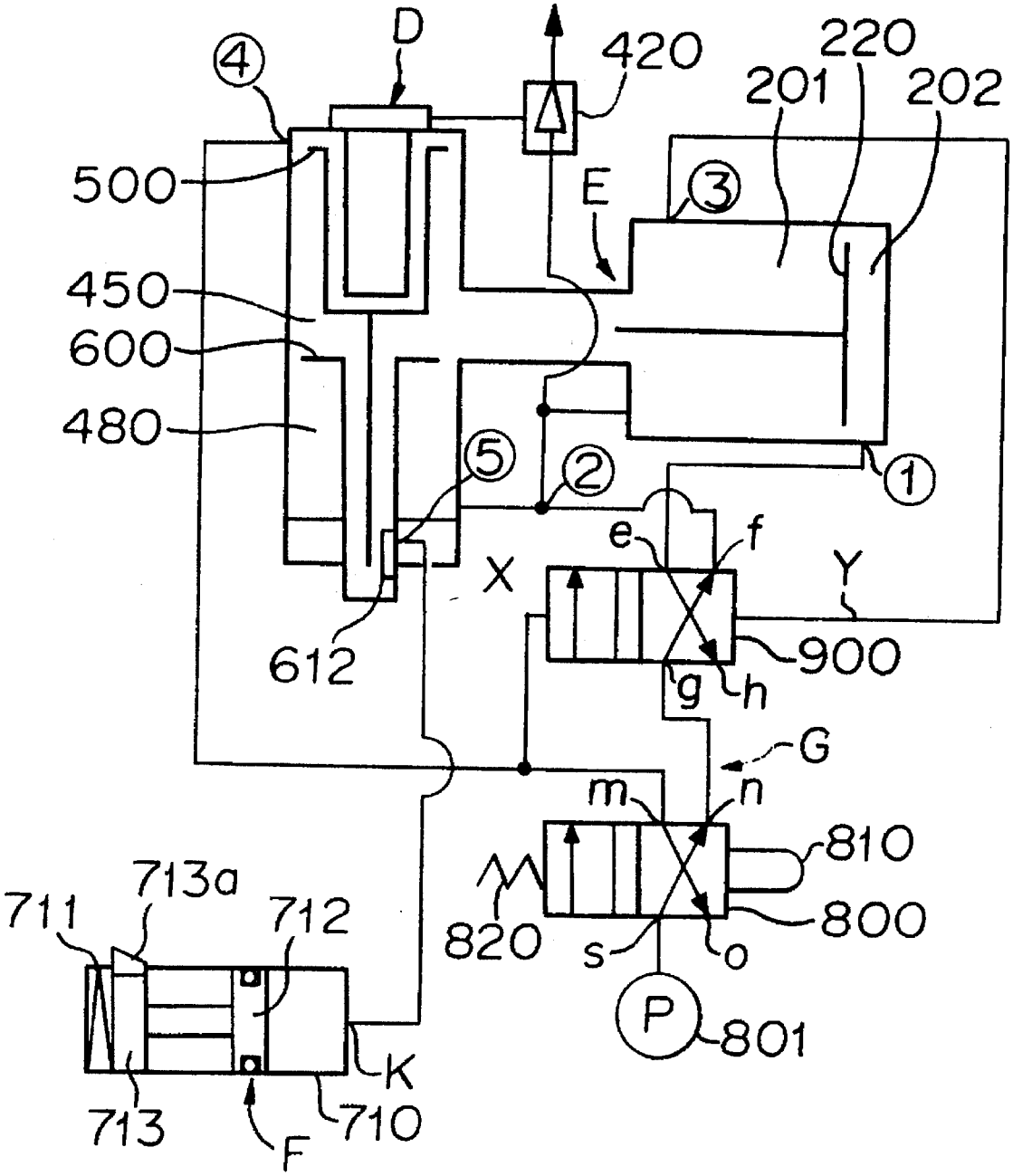
FIG. 8 shows the air piping system in which both trigger valve and control valve are switched in the second stage corresponding to the states shown in FIG. 5, 6 and FIG. 7.

The valve section G is comprised as shown in FIG. 2, FIG. 4 and FIG. 8, the control valve 900 is installed on the air cylinder 200 as shown with two dotted imaginary lines and composed with two positioned pilot operated exchanging valve, and a trigger valve 800 is installed in the position wherein the oil cylinder 200 crosses to the jaw cylinder 400 as shown with the two-dotted imaginary lines in FIG. 1 and activates to push or release the push button 810. In FIG. 2, numeral 801 is a pressurized air source such as an air compressor or the like, the port h of the control valve 900 and the port O of the trigger valve 800 are opened to the outside, and the outlet port e and port f of the control valve 900 are connected to the air port 1 and air port 2, and the air port 3 is connected to the pilot air line Y. Also, an outlet port m is connected to a piloted air path X and an air port 4 located on the upper portion of the jaw cylinder 400, an outlet port n is connected to an inlet port g of the control valve 900. Furthermore, in the cylinder cover 460, an air port 5 is shaped, and through the air port 5 the air chamber 480 is connected to a port K of the rivet feed air cylinder 710, and when the lower piston 600 reaches the upper dead point (shown in FIG. 7), the pressurized air in the air chamber 480 is supplied to the rivet feed air cylinder 710 through an air groove 612 shaped on the bottom portion of the outer sleeve 610.

The continuous riveting machine according to the present invention performs riveting as follows.

Usually, the rivet holding belt 730 is housed in the magazine 750 being wound in a spiral, when not used for riveting. As shown in FIG. 1 and FIG. 2, the trigger button 810 is released, and the blind rivet 740 is elastically supported by the elastic ring 621 installed in the nose piece 620 so as not to fall downwardly.

Figure 3:
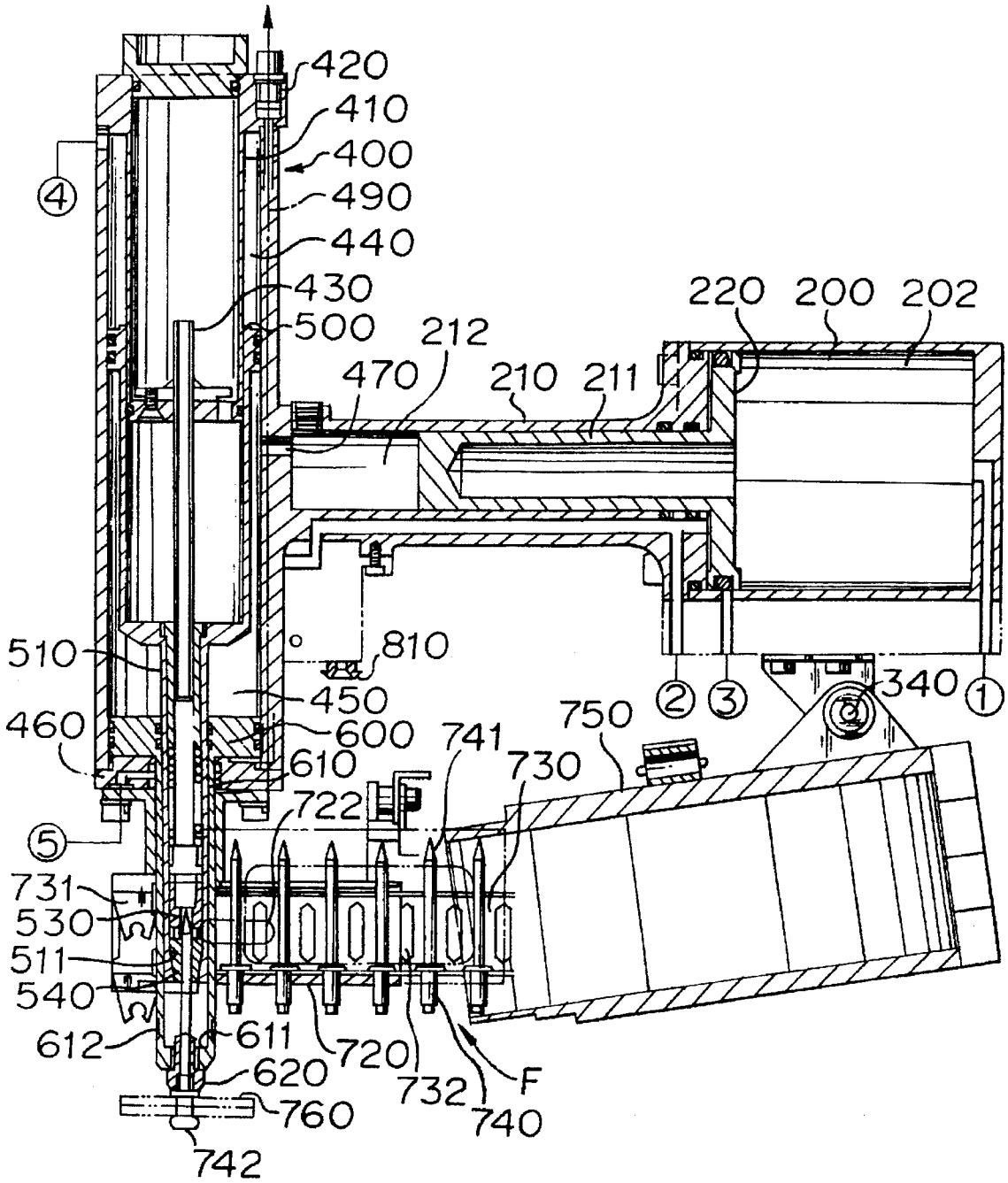
FIG. 3 shows a sectional vertical view of the embodiment shown in FIG. 1 and shows the upper piston pulled up as much as specified.

As shown in FIG. 3, the rivet main body 742 of the blind rivet 740 is inserted in the hole 760 of the sheet metals, and in pushing the push button 810, as shown in FIG. 4, the spool of the trigger valve 800 moves toward the left, pressurized air is then charged in the rear air chamber 202 of the air cylinder 200 through the air ports s and h of the trigger valve 800, and the air ports g and e of the control valve 900, then the piston 220 advances, the oil piston 211 also advances, and the oil stored in the oil chamber 212 is fed into the oil chamber 450 of the jaw cylinder 400, and the upper piston 500 is pushed up as much as specified distance. Accordingly, the inner sleeve 510 is raised.

In this case, as a pair of jaws 540 are biased downwardly by the spring 520 through the jaw pusher 530, the jaws 540 extrude downwardly while sliding along the tapered surface 511, each of the jaws approach each other, and raise upwardly while gripping the rivet-core-stem 741 of the blind rivet 740. By the rising of the rivet-core-stem 741, the fastening operation of the blind rivet is performed. Next, as the rivet main body 742 is being pressed downwardly by the tip of the nose piece 620, the rivet-core-stem 741 is torn. In this case, as the air chamber 480 and the front air chamber 201 of the air cylinder 200 are opened toward the air through the port 2, the outlet ports f and h of the control valve 900, then the lower piston 600 is pushed downwardly, and only the upper piston 500 is raised upwardly.

As mentioned above, when the piston 220 advances, the pressurized air in the rear air chamber 202 is supplied into the pilot air path Y through the port 3, the control valve advances and the air circuit becomes as shown in FIG. 8. The pressurized air delivered from the air source 801 is then supplied into the port 2 through ports s, n, g, h, while the pressurized air in the rear air chamber 202 of the air cylinder 200 is discharged into the air through the ports e, h, and similarly the pressurized air in the pilot air path X and the air chamber 440 are discharged into the air through the ports m, o.

Figure 5:
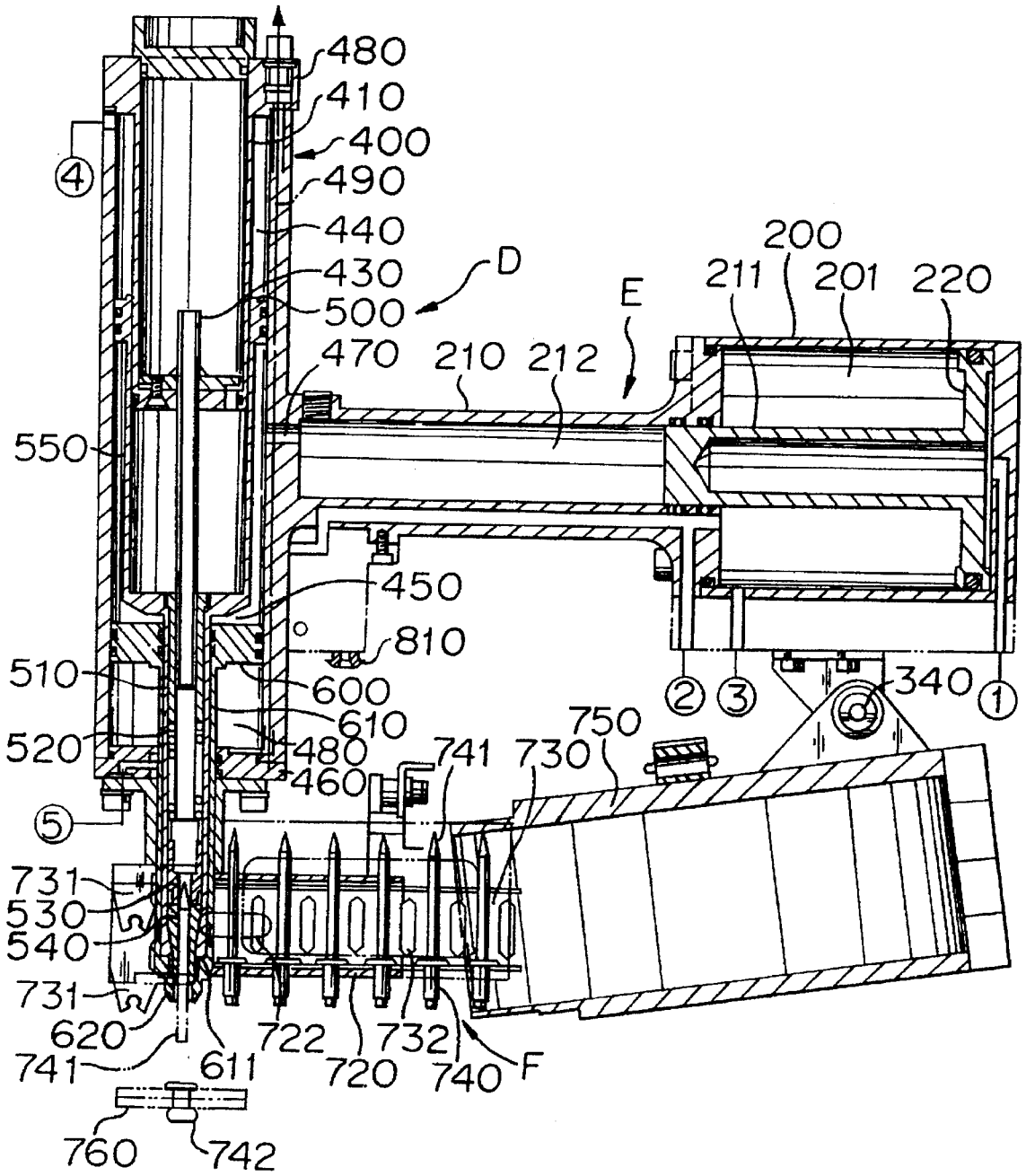
FIG. 5 shows the embodiment shown in FIG. 1 in which the lower piston ascended following the ascension of the upper piston for further raising the upper piston.
Figure 6:
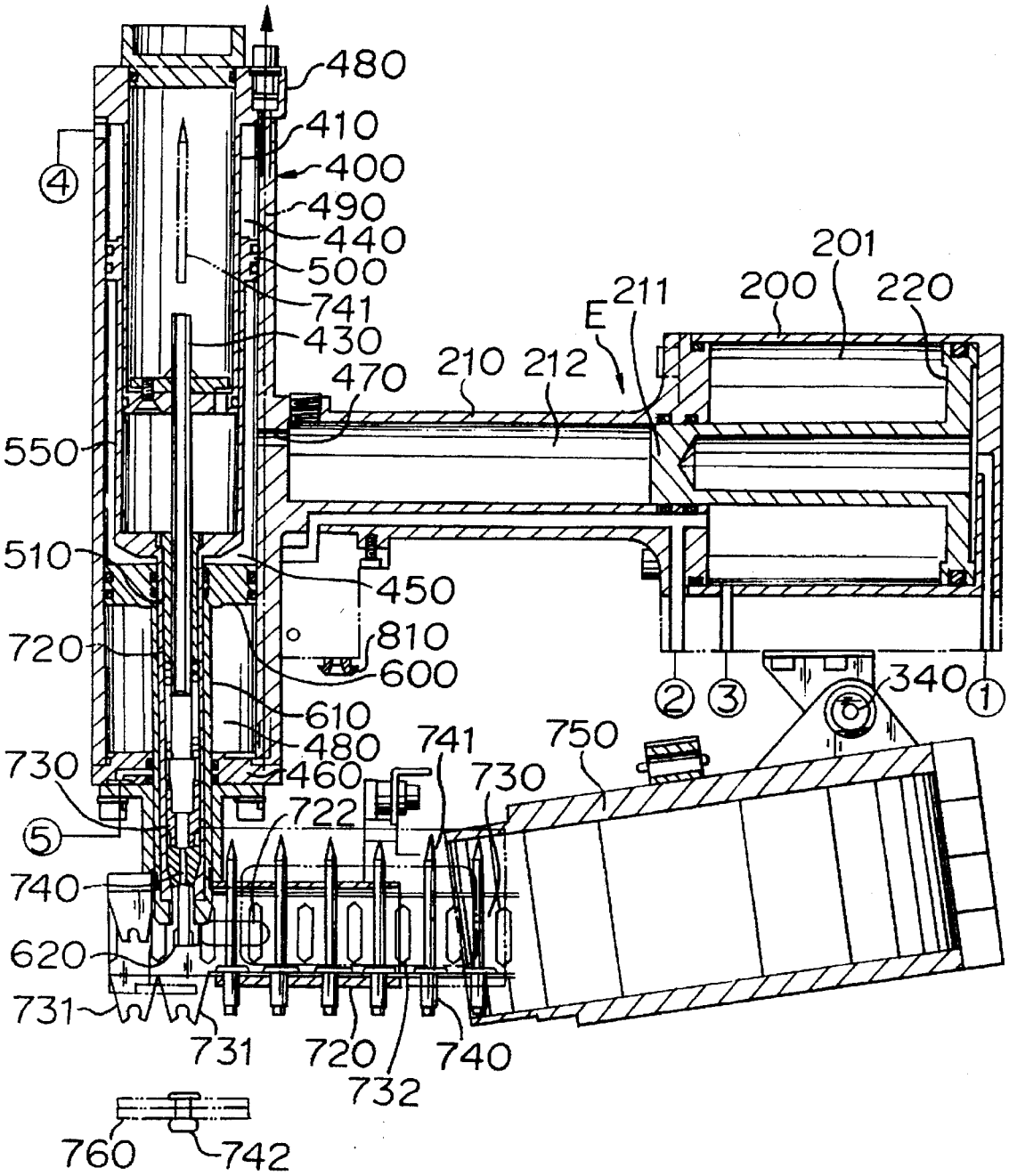
FIG. 6 shows the embodiment shown in FIG. 1 in which a blind rivet is fastened and torn core rivet stem is absorbed in the core-stem storing case.

Accordingly, as shown in FIG. 5 to FIG. 7, the upper piston 500 and the lower piston 600 are raised to each dead point.

In FIG. 5, as the oil piston 211 returns (of course, the air piston 220 also returns), the lower piston 600 rises to the position near the cylindrical sleeve 550, and the pressurized air is charged in the vacuum air ejector 420. Vacuuming of the inside of the torn-stem storing chamber 410 then starts. Also, the lower piston 600 is raised against the upper piston, and concurrently the bottom wall 611 of the outer sleeve 610 contacts the bottom end of the inner sleeve 510, the upper end of the nose piece 620 pushes the tip portion of jaws 50 upwardly, then the jaw becomes released.

FIG. 6 shows the upper piston 500 and the lower piston 600 on the way of being raised and the torn core rivet stem 741 absorbed in the storing chamber 410.

FIG. 7 shows the upper piston 500 and the lower piston 600 having reached the dead points. At that time, as the pressurized air is supplied to the port K of the rivet supply air cylinder 710 from the port 5, the rivet supply piston 712 advances, the feed pawl 713*a* also advances along the long hole 722, and the feed pawl 713*a* engaged with the feed hole 732 of the blind rivet-holding belt 730 draws the belt 730 from the storing magazine 750, and advances it as much as one pitch along the extrusions of the guide device 720, and finally sets the tip portion of the core stem 741 on the axial center located under the nose piece.

Subsequently, in releasing the push button 810, the valve section D is transferred to the state shown in FIG. 2, and as the trigger valve 800 returns to the original position by the spring 820, the pressurized air from the air source 801 is supplied to the pilot air path X of the control valve 900, then also the control valve 900 returns to its original position. In this time, the pressurized air in the pilot air path Y was already discharged into the air from the ports f, h through the ports 3, 2.

In the above-mentioned valve conditions, as the pressurized air is supplied to the air chamber 440 from the air port 4 through the ports s, m of the trigger valve 800, the pressurized air in the air chamber 480 is discharged into the air through the ports 2, f, h, and the upper piston 500 and the lower piston 600 together descend to the lower dead position. At this time, concurrently with the core stem 714 of the blind rivet 740 being held in the released jaws after passing through the nose piece 620, the tip portion of the nose piece 620 descends while bending downwardly the upper and lower tabs 731 of the rivet holding belt 730. The descending of the noise piece 620 is described in detail with reference to FIG. 10 to FIG. 13.

When the nose piece 620 descends, as the air supply to the rivet feed air cylinder 710 is stopped and the pressurized air in the cylinder 710 is discharged, the rivet feed piston 712 returns to the original position by the spring action, but as the blind rivet-holding belt 730 is restricted to movement toward the reverse direction by the reverse-preventing nail 723, the feed pawl 713*a* is disengaged from the feed hole 732, and reverses as much as one pitch just as the blind rivet-holding belt 730 is stopped.

In this case, as the blind rivet-holding belt 730 is being elastically pressed to the guide device 720 by the deviation preventing plate spring 770, then the belt 730 engages surely with the feed pawl 730 without any deviation. As mentioned above, the preparation for fastening the blind rivet 740 is completed.

The subsequent operation is the same as the operation described before, and by repeating above-described operation, it is possible to fasten the blind rivet 740.

Figure 10:
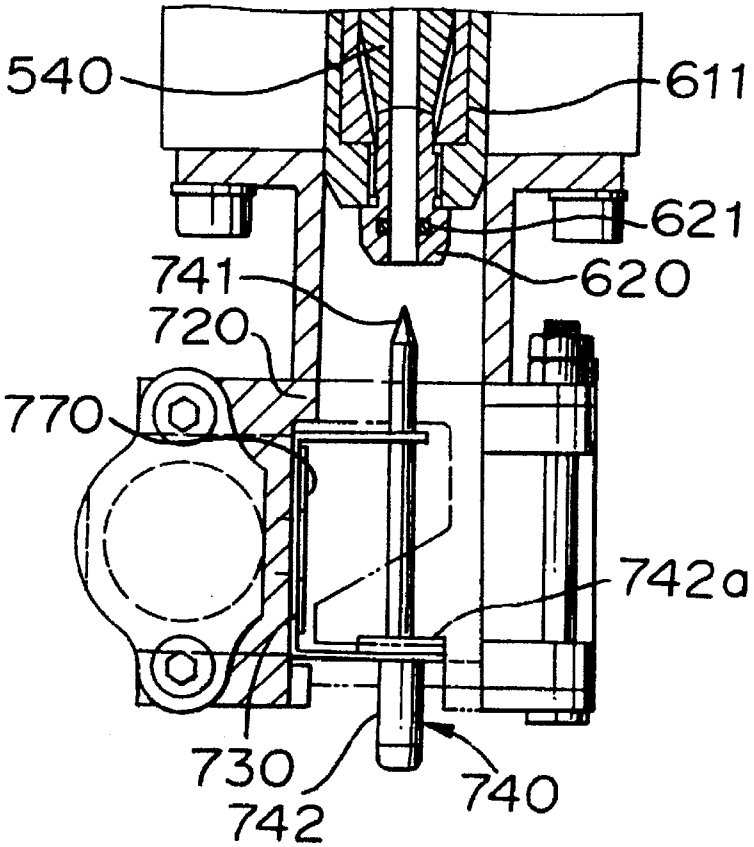
FIG. 10 shows a partial sectional vertical side view of the rivet supply section of the embodiment shown in FIG. 1, and shows the blind rivet held in the rivet-holding belt transferred under the nose piece 620.

FIG. 10 to FIG. 13 show the descending of the nose piece 620, and FIG. 10 shows one piece of the blind rivet 740 being fed, and the head 742*a* of the rivet main body 742 is placed on the lower tab 731.

Figure 11:
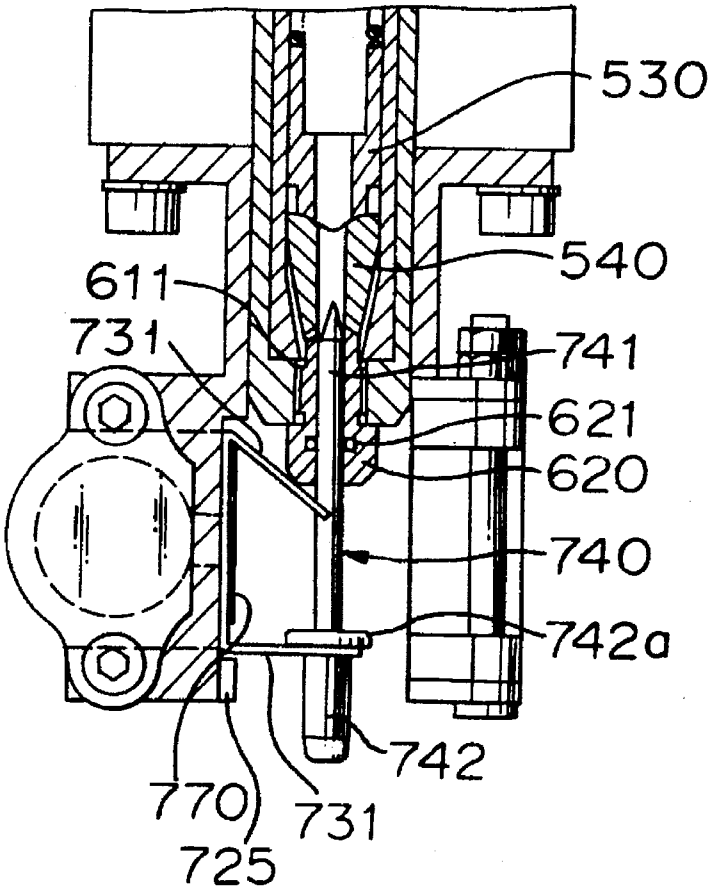
FIG. 11 shows a partial sectional vertical side view of the rivet supply section of the embodiment shown in FIG. 1, and shows the upper tab of the rivet holding belt bent downwardly while the nose piece 620 is slidably descending along the blind rivet supported on the lower tab 731 of the belt.

FIG. 11 shows the tip portion of the nose piece bending the upper tab 731 concurrently with the core-stem 741 being input into the nose piece 620.

Figure 12:
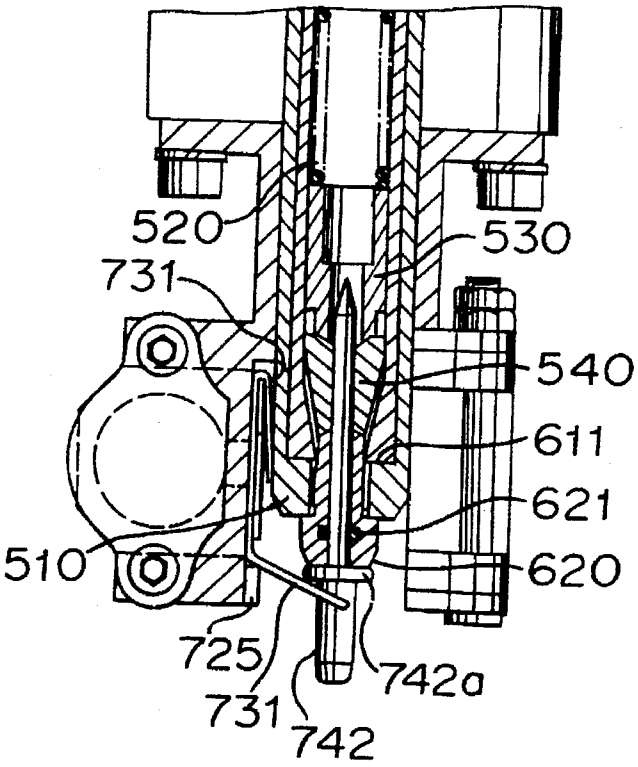
FIG. 12 shows a partial sectional vertical side view of the rivet supply section of the embodiment shown in FIG. 1, and shows the lower tab 731 being bent by the further descending of the nose piece 620.

FIG. 12 shows furthermore that the nose piece 620 descends, and the upper tab 731 is completely bent, the core-stem 741 engages with the jaws 54 after passing through the nose piece 620, and the head 742*a* of the rivet main body 742 being contacted to the tip portion of the nose piece 620 bends the lower tab 731 slightly. As the base edge of the lower tab 731 is supported on the extrusion 725 of the lower guide, by applying the extrusion 725 and the required resistive force so that the head 742*a* bends the lower tab 731, the blind rivet 740 is perfectly inserted up to the head 742*a* into the nose piece by overcoming the resistance of the elastic ring 621.

Figure 13:
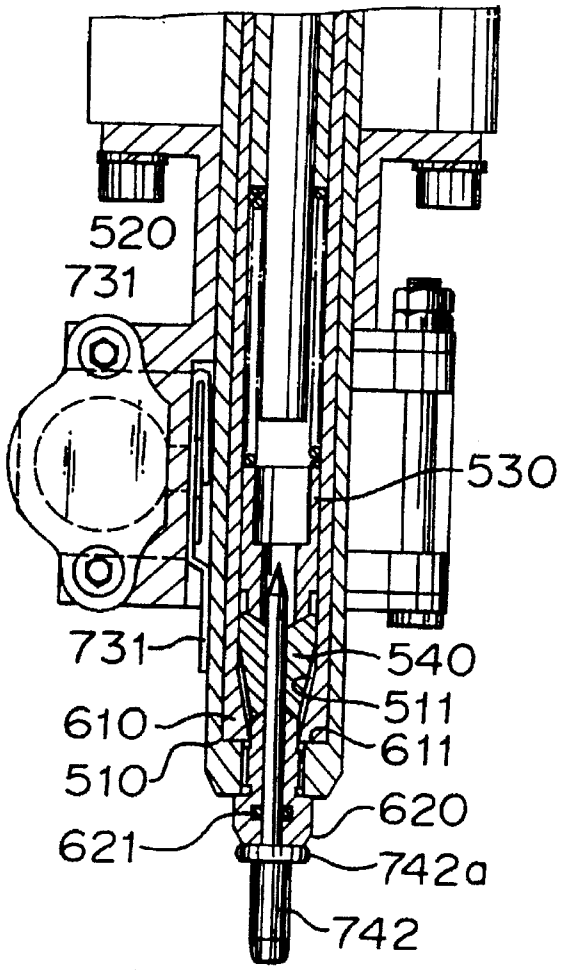
FIG. 13 shows a partial sectional vertical side view of the rivet supplying section of the embodiment shown in FIG. 1, and shows both upper and lower tabs bent and the nose piece 620 having reached the lower dead point.
Figure 14:
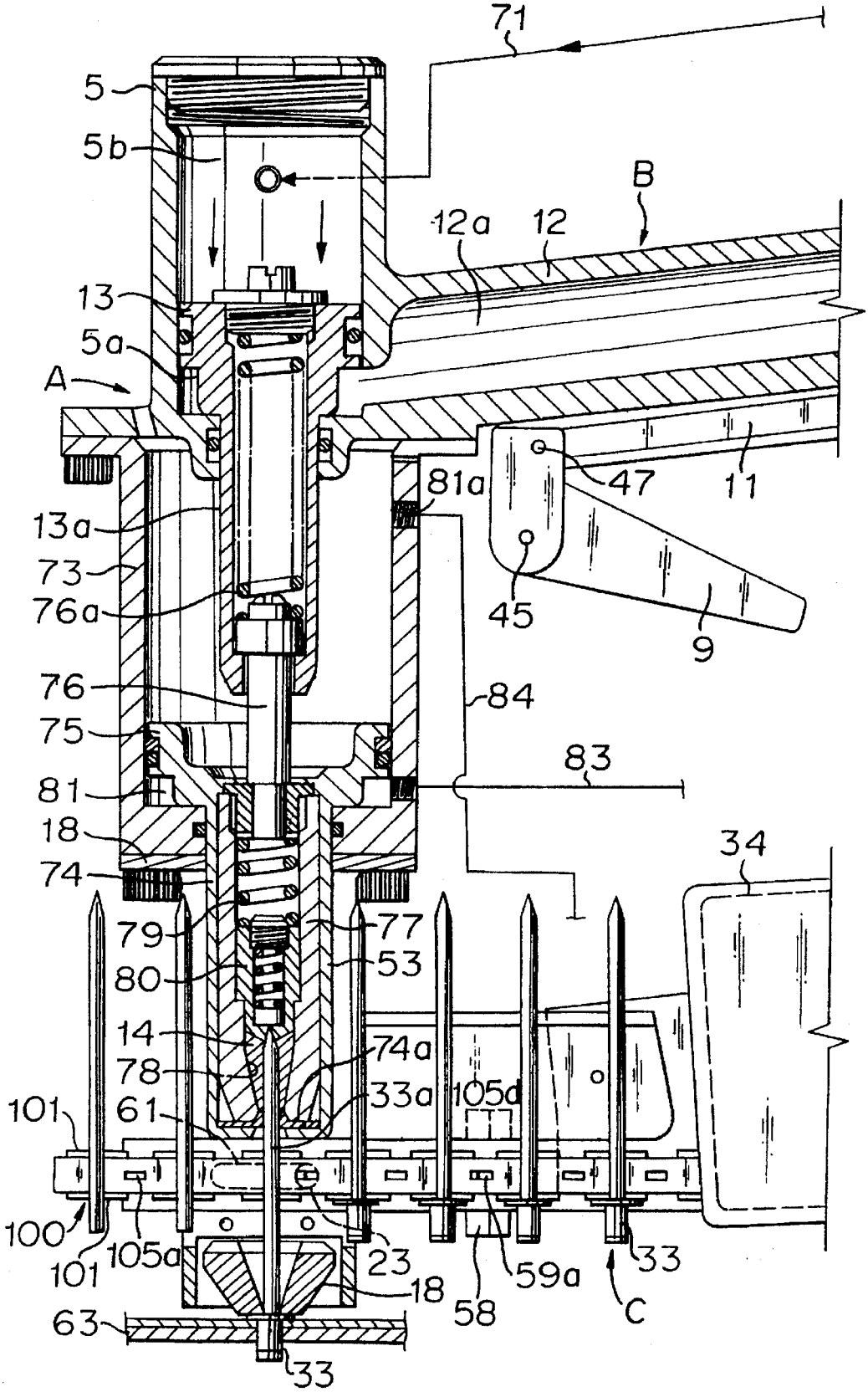
FIG. 14 PRIOR ART
FIG. 14 shows a partial sectional vertical front view of the conventional riveting machine and shows the head of the blind rivet clamped and pressed to the sheet metal by a pair of clamps 19.
Figure 15:
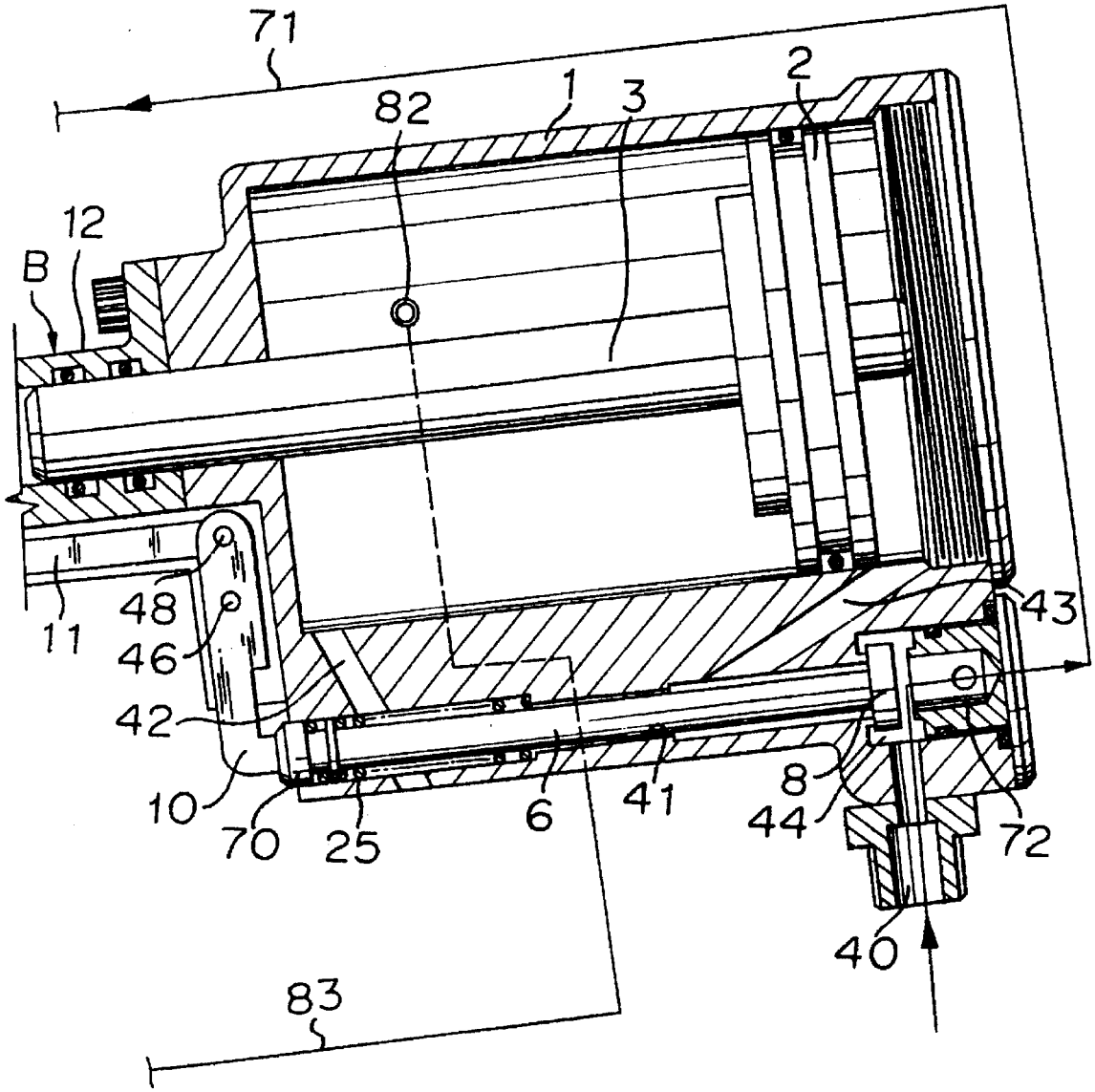
FIG. 15 PRIOR ART
FIG. 15 shows a partial sectional vertical front view of the conventional riveting machine shown in FIG. 14. In combining this figure with FIG. 14, the riveting machine is formed as a whole.
Figure 16:
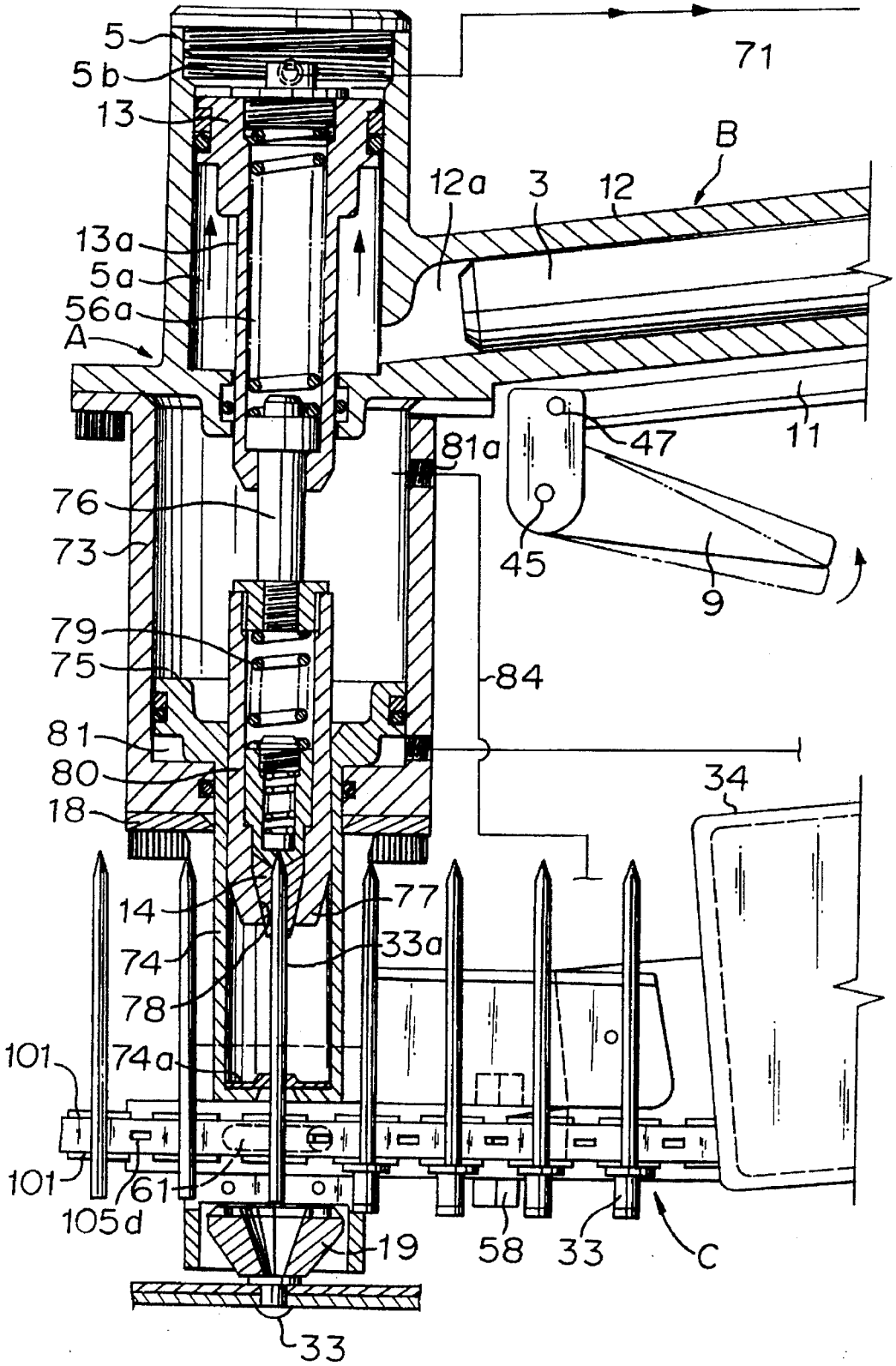
FIG. 16 PRIOR ART
FIG. 16 shows a partial sectional vertical front view of the conventional riveting machine shown in FIG. 14. This figure shows the core-stem of the rivet torn by raising the hydraulic pneumatic piston 13, and the main body of the rivet 33 fastened in the sheet metals.
Figure 17:
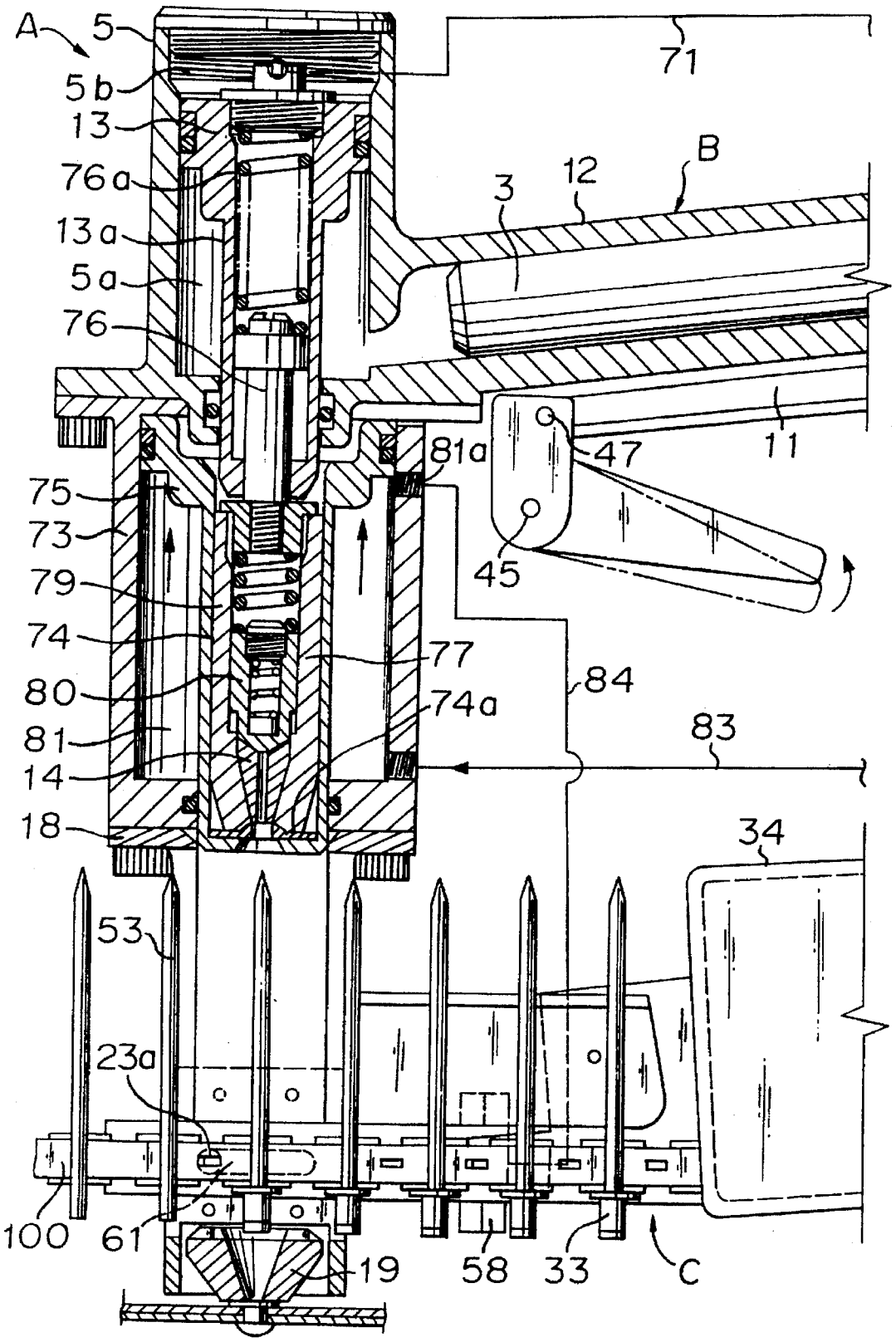
FIG. 17 PRIOR ART
FIG. 17 shows a partial sectional vertical front view of the conventional riveting machine shown in FIG. 14. This figure shows the pneumatic hydraulic piston 13 and chuck piston 75 raised for transferring the new blind rivet to the position to be riveted.
Figure 18:
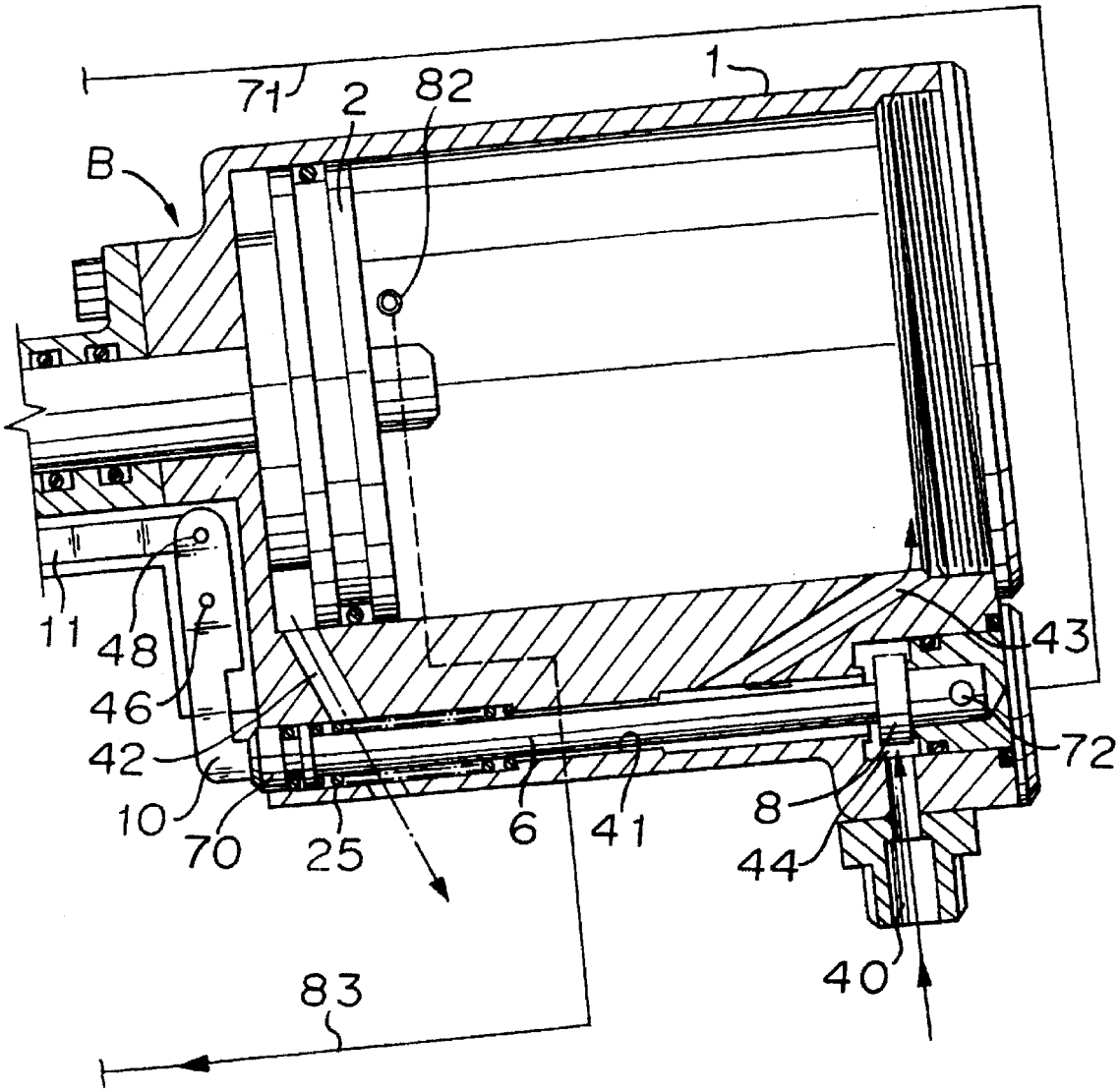
FIG. 18 PRIOR ART
FIG. 18 shows a partial sectional vertical front view of the conventional riveting machine shown in FIG. 14 corresponding to FIG. 16 and FIG. 17.
Figure 19:
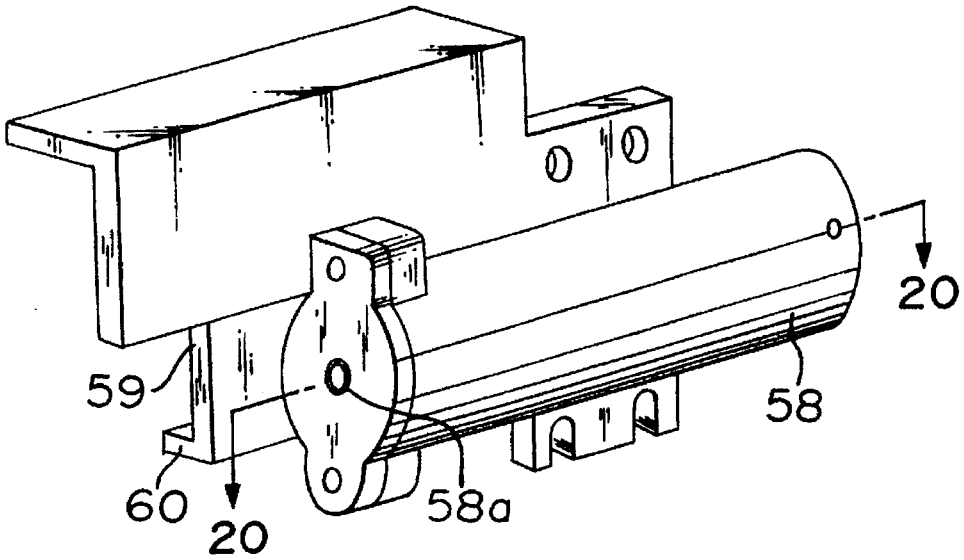
FIG. 19 PRIOR ART
FIG. 19 shows a perspective view of the rivet supply section excepting a rivet containing magazine of the conventional riveting machine shown in FIG. 14.
Figure 20:
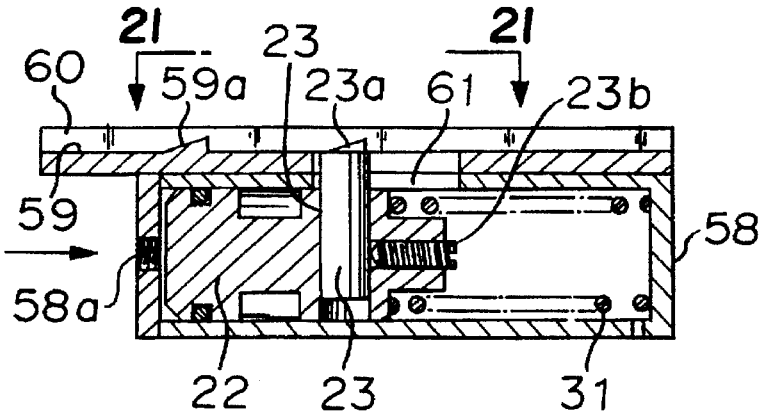
FIG. 20 PRIOR ART
FIG. 20 shows a section view taken along line D—D shown in FIG. 19.
Figure 21:
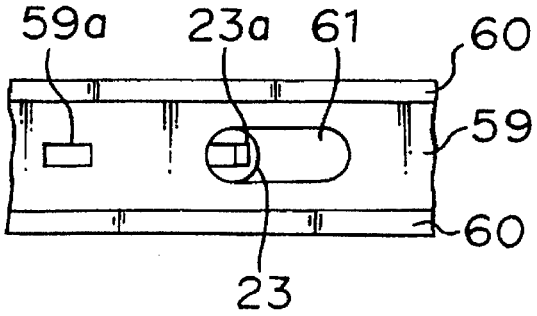
FIG. 21 PRIOR ART
FIG. 21 shows the guide plate 59 seen from the side having intrusions 60.
Figure 22:
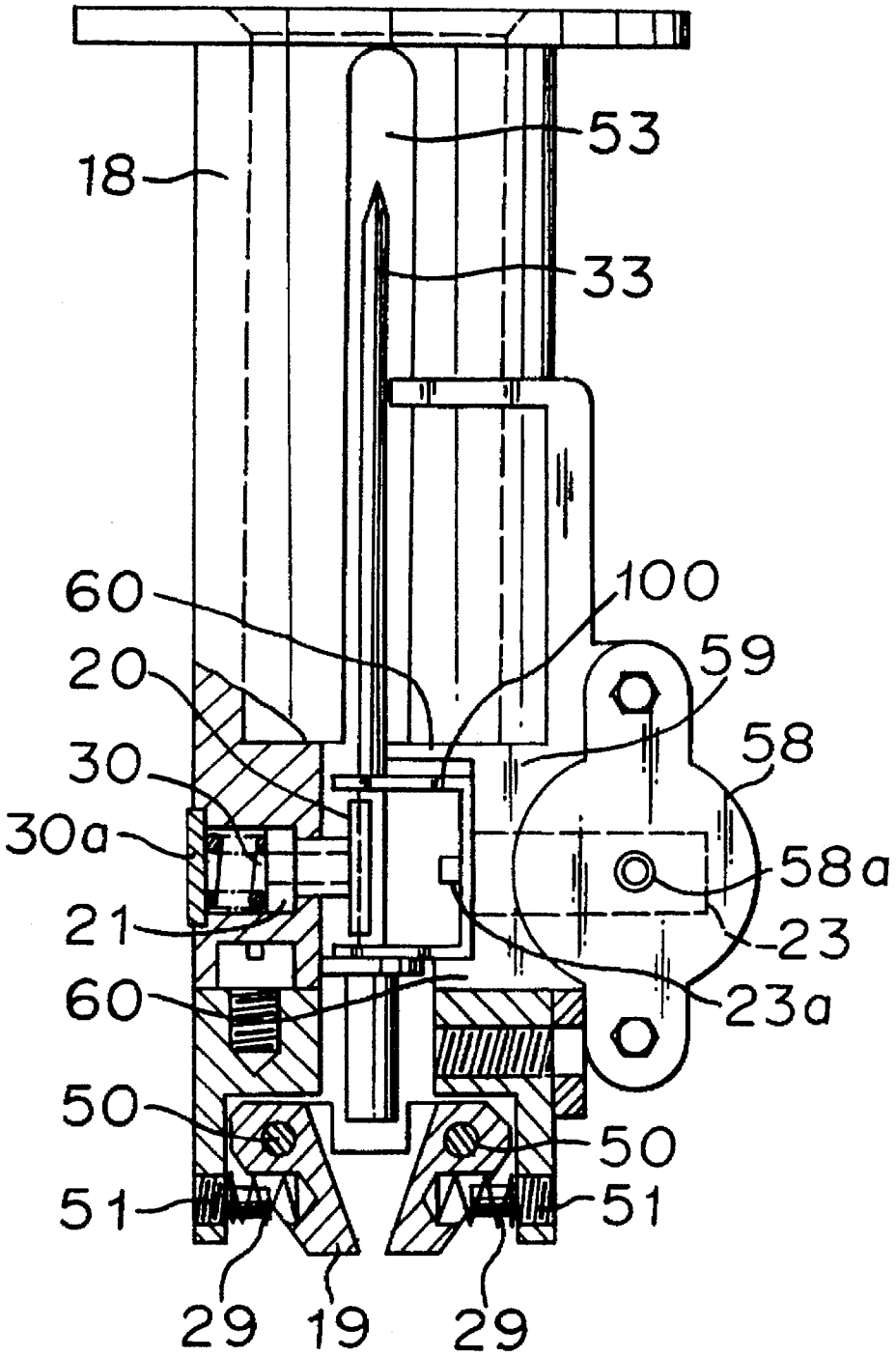
FIG. 22 PRIOR ART
FIG. 22 shows a partially sectioned vertical side view of the rivet nose 18 of the conventional riveting machine.
Figure 23:
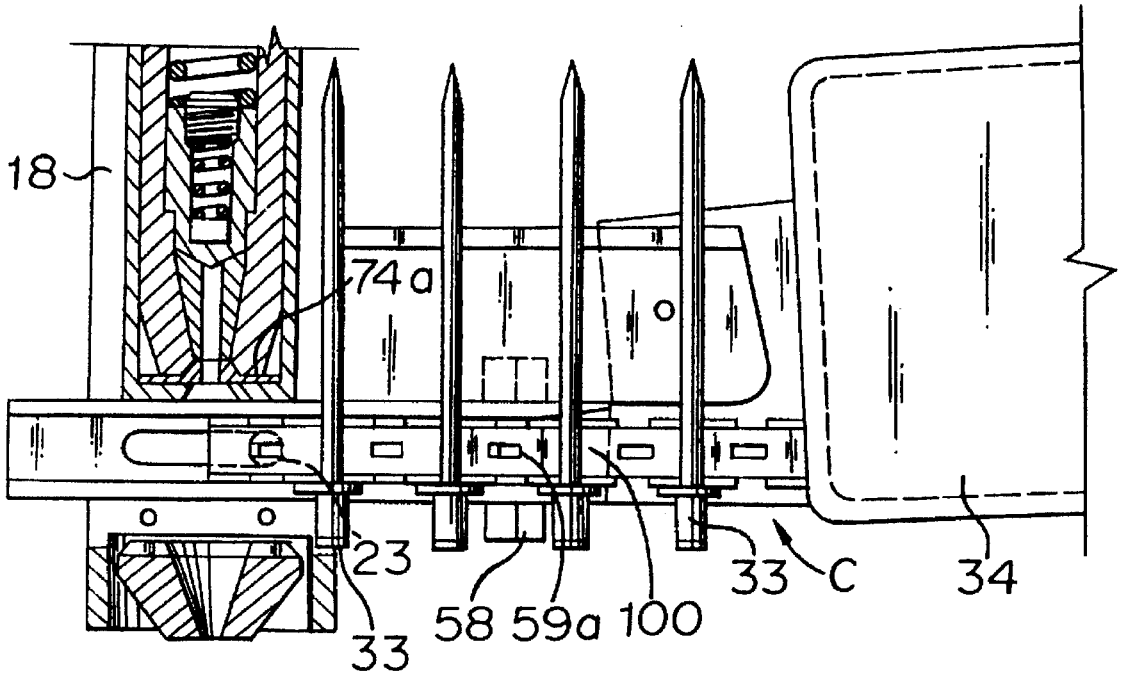
FIG. 23 PRIOR ART
FIG. 23 shows an explanatory drawing of the rivet supply section showing the rivet-holding belt supplied in the conventional riveting machine.

FIG. 13 shows the nose piece 620 descends down to the lower dead point as the blind rivet 740 is perfectly inserted in the nose piece, and the lower tab 731 is perfectly bent.

According to the above-described present invention, the following effects are realized, namely, (1) In the conventional machine, when the nose piece and jaws are in the portion gripping the blind rivet-holding belt, preparation for fastening the rivet is completed, but in this machine according to the present invention, as the nose piece and jaws decend while bending the tabs of the blind rivet and also the nose piece is being attached to the descending outer sleeve, it is possible to use the blind rivets usually provided on the market.

(2) As used core-stems are particularly stored in the case in a lump against the blind rivet holding belt made of plastic material, then the separate collection of scrapped materials becomes possible.

(3) Even if this continuous riveting machine is transferred or transported, as the blind rivet is held by the elastic force of the elastic ring in the nose piece, the blind rivet does not slip out of the machine.

What is claimed is:

1. A continuous riveting machine comprising:

a main body section, a driving section, a rivet supply section and a valve section;

(a) said main body comprising a core-stem storing case provided with a vacuum air ejector for vacuuming the inside of said case, a jaw cylinder provided with said core-stem storing case on the upper end thereof and a cylinder cover on the bottom thereof, an upper piston inserted in said jaw cylinder, said upper piston shaped as a cup opened upwardly, said piston slidably inserted on said core-stem storing case, said piston integrated in one piece with a hollow cylindrical sleeve having a hollowed bottom on the bottom thereof, said cylindrical sleeve having an inner sleeve integrated in one piece on the bottom thereof, said inner sleeve having a tapered surface converging toward the tip thereof in the inner tip thereof, a lower piston inserted in the lower portion of said jaw cylinder, said lower piston having an outer sleeve integrated in one piece at the bottom thereof, said outer sleeve being freely slidable in the hole of said cylinder cover of said jaw cylinder, said outer sleeve being freely slidable on said inner sleeve, said outer sleeve having a nose piece on the bottom portion thereof, said nose piece having an elastic ring enabling a core-stem of a blind rivet to hold therein, a pair of jaws slidably fit to said tapered surface, said jaws being biased downwardly and externally by a spring via a sharply edged jaw pusher, a core-stem absorbing pipe fixed to the bottom plate of said core-stem storing case after penetrating said bottom plate, said pipe being inserted in said inner sleeve at the lower end thereof:

(b) said driving section comprising an air cylinder having a piston, an oil cylinder having an oil piston integrated in one piece with said piston of said air cylinder, said oil cylinder supplying pressurized hydraulic oil into an oil chamber shaped between said upper piston and said lower piston inserted in said jaw cylinder through a connecting oil hole shaped on the side wall of said jaw cylinder, a first air port supplying pressurized air into a rear air chamber of said air cylinder, a second air port supplying pressurized air into a front air chamber of said air cylinder, said vacuum air ejector, an air chamber formed between said lower piston of said jaw cylinder and said cylinder cover of said jaw cylinder, and a third air port connected to an air port provided on the wall of said air cylinder located directly behind said far advanced piston, (c) said rivet supply section comprising a construction transferring each core stem of a blind rivet held with specified distance in a blind rivet-holding belt toward the lower position under said nose piece installed in said outer sleeve when said upper piston and lower piston inserted in said jaw cylinder reach each lower dead position;

(d) said valve section comprising a two positioned trigger valve manipulated by hand, a piloted two positioned control valve operated by pressurized pilot air fed from one of the outlet ports of said trigger valve and said third air port, and an air control system comprising one outlet port of said control valve being connected to said first air port, another outlet port of said control valve being connected to said second air port, one outlet port of said trigger valve being connected to an air port installed on the upper portion of said jaw cylinder, another outlet port of said trigger valve being connected to one inlet port of said control valve, other inlet ports of said control valve and said trigger valve are discharged into the air, and another inlet port of said trigger valve is connected to a pressurized air source.

* * * * *